US006209456B1

(12) United States Patent
Murray et al.

(10) Patent No.: US 6,209,456 B1
(45) Date of Patent: Apr. 3, 2001

(54) WEB- AND SHEET-FED PRINTING UNIT USING VARIOUS INK TYPES, PARTICULARLY WATER-BASED INKS

(75) Inventors: Robert Richard Murray, Madbury; Roland Thomas Palmatier, Durham, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/004,967

(22) Filed: Jan. 9, 1998

Related U.S. Application Data

(63) Continuation-in-part of application No. 08/614,591, filed on Mar. 13, 1996, now Pat. No. 5,758,580, which is a continuation-in-part of application No. 08/615,351, filed on Mar. 13, 1996, now Pat. No. 5,694,848.

(51) Int. Cl.[7] ..... B41F 23/04

(52) U.S. Cl. ..... 101/487; 101/488; 101/489; 101/491; 101/147; 101/349.1; 101/216

(58) Field of Search ..... 101/487, 491, 101/492, 484, 483, 488, 450.1, 216, 219, 147, 148, 230, 349.1

(56) References Cited

U.S. PATENT DOCUMENTS

| | | | | |
|---|---|---|---|---|
| 2,260,364 | | 10/1941 | Case . | |
| 2,319,853 | | 5/1943 | Durham . | |
| 2,556,262 | | 6/1951 | Faeber . | |
| 2,651,992 | * | 9/1953 | Säuberlich | 101/488 |
| 2,804,693 | | 9/1957 | Brodie . | |
| 2,972,298 | | 2/1961 | DeMarchi et al. . | |
| 2,972,302 | * | 2/1961 | Bernardi | 101/488 |
| 2,972,303 | * | 2/1961 | DeMarchi et al. | 101/491 |
| 3,031,961 | * | 5/1962 | Czeropski et al. | 101/487 |
| 3,141,408 | * | 7/1964 | Bernardi et al. | 101/488 |
| 3,356,030 | * | 12/1967 | Greubel | 101/452 |
| 3,412,053 | * | 11/1968 | Pugliese | 101/491 |
| 3,686,771 | * | 8/1972 | Schone et al. | 101/230 |
| 3,741,115 | | 6/1973 | Keller . | |
| 3,877,372 | | 4/1975 | Leeds . | |

(List continued on next page.)

FOREIGN PATENT DOCUMENTS

| | | | | |
|---|---|---|---|---|
| 474 605 | | 6/1951 | (CA) . | |
| 41 19 348 A1 | | 6/1991 | (DE) . | |
| 0549235 | | 11/1943 | (GB) . | |
| 0062053 | * | 4/1983 | (JP) | 101/424.1 |
| 0191152 | | 8/1987 | (JP) . | |
| 362227749 | * | 10/1987 | (JP) . | |
| 321453 | | 6/1989 | (JP) . | |
| 4020099382 | | 4/1990 | (JP) . | |
| 0101938 | | 4/1991 | (JP) . | |

OTHER PUBLICATIONS

Leach, R. H. et al., "Inks and Varnishes for Specific Purposes," The Printing Ink Manual, Fifth Edition, 1993 pp. 571–576.

*Primary Examiner*—Eugene Eickholt
(74) *Attorney, Agent, or Firm*—Kenyon & Kenyon

(57) ABSTRACT

A printing unit of a rotary printing press for using various ink types, particularly water-based inks, is provided. The printing unit includes an inking mechanism, a print cylinder, and a blanket cylinder. The inking mechanism and the cylinders are mounted in side walls of the printing unit. A housing at least partially surrounds the inking mechanism and the cylinders to maintain a surrounding atmosphere within an at least semi-enclosed area of the printing unit. A chemical agent may be selectively added to the atmosphere in the semi-enclosed area to reduce the rate of evaporation of a substance in the ink. The printing unit also includes a cooling unit for maintaining an ink carrying surface of one or more of the print form, the printing blanket, and the inking unit at a predetermined temperature which is suitable for printing with water-based inks. The printing unit may be a sheet-fed printing press.

60 Claims, 19 Drawing Sheets

U.S. PATENT DOCUMENTS

| | | | | |
|---|---|---|---|---|
| 3,951,892 | | 4/1976 | Drury, Jr. et al. . | |
| 4,137,083 | | 1/1979 | Hedrick . | |
| 4,156,388 | * | 5/1979 | Mabrour | 101/148 |
| 4,173,554 | | 11/1979 | Sulzberg . | |
| 4,214,523 | * | 7/1980 | Mabrour et al. | 101/148 |
| 4,278,467 | | 7/1981 | Fadner . | |
| 4,772,518 | | 9/1988 | Marthe . | |
| 4,854,969 | | 8/1989 | Bassemir et al. . | |
| 4,920,881 | | 5/1990 | Tafel . | |
| 4,954,556 | * | 9/1990 | Bull et al. | 101/491 |
| 5,026,755 | | 6/1991 | Kveglis et al. . | |
| 5,098,478 | | 3/1992 | Krishnan et al. . | |
| 5,132,706 | * | 7/1992 | Yuasa et al. | 101/465 |
| 5,174,206 | | 12/1992 | Molinatto . | |
| 5,189,960 | | 3/1993 | Valentini et al. . | |
| 5,309,838 | | 5/1994 | Kurz . | |
| 5,335,596 | * | 8/1994 | DeMoore et al. | 101/147 |
| 5,370,046 | | 12/1994 | Spiegel et al. . | |
| 5,370,906 | | 12/1994 | Dankert . | |
| 5,375,518 | | 12/1994 | Kurz . | |
| 5,417,749 | | 5/1995 | Krishnan et al. . | |
| 5,429,051 | * | 7/1995 | Laubscher | 701/488 |
| 5,447,102 | * | 9/1995 | Pfieffer et al. | 101/492 |
| 5,452,657 | | 9/1995 | Kurz . | |
| 5,465,661 | * | 11/1995 | White | 101/487 |
| 5,471,927 | | 12/1995 | Frank et al. . | |
| 5,535,674 | | 7/1996 | Vrotacoe et al. . | |
| 5,611,278 | * | 3/1997 | Garner et al. | 101/341.1 |
| 5,694,848 | * | 12/1997 | Palmantier | 101/487 |
| 5,725,646 | * | 3/1998 | Krishman et al. | 101/491 |
| 5,740,740 | * | 4/1998 | Stephan | 101/483 |
| 5,758,580 | * | 6/1998 | Murray | 101/491 |
| 5,778,789 | * | 7/1998 | Kishman et al. | 101/491 |

* cited by examiner

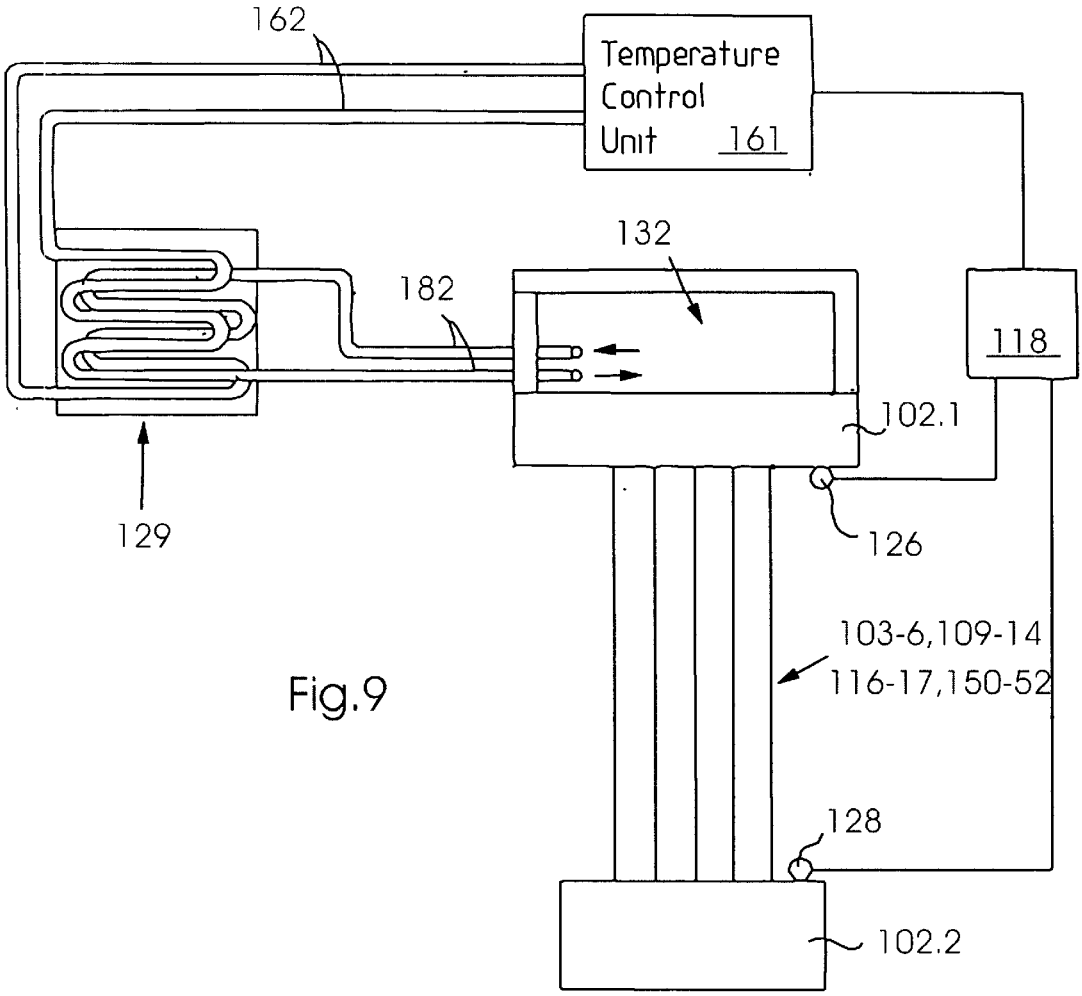
Fig.9
Fig.9a
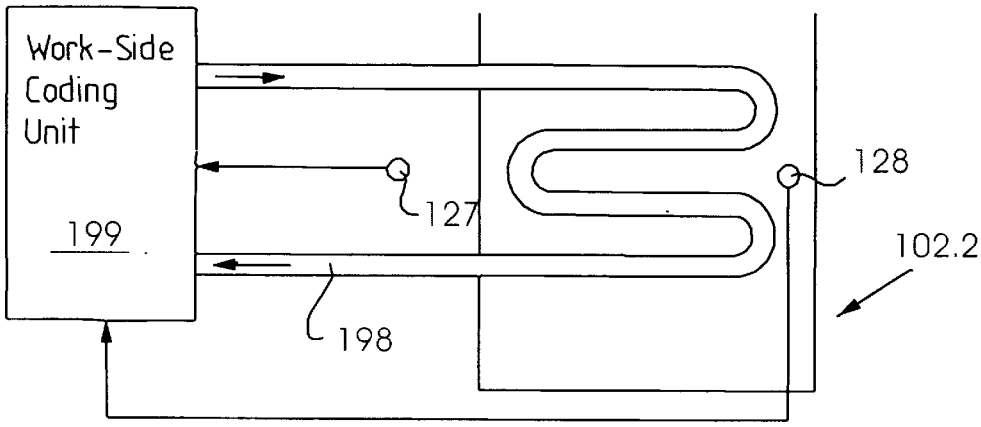

WEB- AND SHEET-FED PRINTING UNIT USING VARIOUS INK TYPES, PARTICULARLY WATER-BASED INKS

This application is a continuation-in-part of U.S. Pat. application Ser. No. 08/614,591, entitled "PRINTING UNIT USING VARIOUS INK TYPES," filed Mar. 13, 1996, and now U.S. Pat. No. 5,758,580, and also a continuation-in-part of U.S. Pat. application Ser. No. 08/615,351, and now U.S. Pat. No. 5,694,848, entitled "PRINTING UNIT FOR WATER-BASED INKS," filed Mar. 13, 1996.

FIELD OF THE INVENTION

The present invention concerns a printing unit for a rotary printing press which can utilize various ink types, and which is applicable to both web-fed and sheet fed environments. In particular, the present invention concerns a printing unit which allows the use of water-based inks, for easy clean-up and ink changing.

BACKGROUND OF THE INVENTION

U.S. Pat. Nos. 5,309,838, and 5,375,518 each purport to disclose a system for keeping the printing plates of a printing press at a moderate temperature. A cooling air blower girder extends longitudinally over the printing plate surface and blows cold air onto the printing plate's surfaces in order to keep its temperature at a desired value. The blast air girder contains at least one heat exchanger and at least one blower as well as at least one air return duct, which together forms a cooling air cycle, through which the air blown onto the printing plate surface is returned to the air inlet of the heat exchanger and optionally mixed with fresh air blown by the blower once again through the heat exchanger onto the printing plate surface. The blast air girder purportedly presents an energy saving compact structural unit for keeping the printing plate surface at a moderate temperature.

U.S. Pat. No. 5,452,657 purportedly relates to a temperature control system for printing press cylinders. It contains at least one compressed air line having at least one blast air opening for blowing cold air against a cylinder which is to be cooled. At least one recirculation circuit which is separate from the cold air of the compressed air line, and by which air which has been blown by the blast air opening onto the cylinder is drawn off by a blower contained in the circulation circuit and thereafter is blown parallel to the cold air again onto the cylinder. In this way, the temperature of the cold air can be active, without prior change of temperature on the cylinder. The cold air deflected by the cylinder is returned to the cylinder for additional cooling.

U.S. Pat. No. 5,098,478 relates to water based ink compositions. The water based ink composition includes water, a pigment, a non-ionic surfactant having a solubility in water of less than about 0.5 wt % and a solubilizing agent sufficient to solubilize substantially all of the non-ionic surfactant.

U.S. Pat. No. 5,026,755 purports to disclose a water based printing ink prepared from polyamid/acrylic graft copolymers. It is prepared by reacting the polyamid with the acrylic monomer or monomers in an alcohol solution in the presence of a free radical peroxidic initiator. The graft copolymer purports to be particularly useful as the resin component of a water based printing ink.

Finally, German laid open patent application DE 41 19 348 A1 purports to disclose a method for offset printing and a printing unit for waterless offset printing. A conventional offset plate is used with a water based printing ink, containing a pigment, water, 5–50 % water soluble macromolecular binding agents, and a hygroscopic organic fluid, preferably a multivalent alcohol.

SUMMARY OF THE INVENTION

The use of prior art air blasting control devices is ineffective in preventing premature dry-up of ink in printing presses and, in fact, may contribute to premature dry-up. This is particularly problematic on those components within the printing unit which are difficult to clean or to gain access to. Moreover, in order to clean the dried ink off of these components, the press must be shut down. Since a shutdown of the press in order to clean off dried ink residue reduces the productivity of the press, there is a need to reduce the formation of dried ink buildup.

The present invention reduces the formation of dried ink build-up by taking advantage of the fact that ink dry-up is caused by the evaporation of a volatile substance, e.g., VOC (volatile organic components), ammonia, ethanol amine or other amine compounds, and/or water, from the ink. In accordance with the present invention, a printing unit is provided which prevents or reduces the evaporation of the substance from the ink, thereby preventing premature ink dry up. The printing unit according to the present invention includes an inking mechanism, a plate cylinder, and a blanket cylinder supported within a frame. During operation of the printing unit, ink is applied as an ink film through the inking mechanism and onto a print form mounted on the print cylinder. A housing is mounted within the frame which at least partially surrounds the inking mechanism and print cylinder. In this manner, a semi-enclosed space surrounds the print cylinder and inking mechanism. Alternatively, the housing may also partially surround the blanket cylinder. The printing unit further includes a chemical supply for applying a chemical agent, e.g., water, VOC, ammonia, ethanol amine (or any other organic amine), in gaseous form into an atmosphere within the semi-enclosed space. By selectively introducing the chemical agent into the atmosphere, evaporation of the substance from the ink film on the inking mechanism and print form is reduced and controlled.

In accordance with a first embodiment of the present invention, the printing unit further includes a cooling mechanism and a humidifier for controlling the atmospheric conditions within the semi-enclosed space. The cooling mechanism and humidifier improve printing conditions in a number of ways. First, the ability of the atmosphere within the semi-enclosed space to absorb the substance from the ink film is a function not only of the amount of the chemical agent in the atmosphere, but also of the temperature and humidity in the atmosphere. In addition, temperature and relative humidity affect print quality independent of ink-dry up problems. For example, if the temperature of the ink (or the surface the ink is being applied to) is too low, ink transfer will be impeded. However, if the temperature is too high, then the ink will adhere to the non-imaged area of the plate as well as the imaged area of the printing plate. This phenomena is known as "toning" of the image. Similarly, if the humidity is too high, condensation will occur, resulting once again in toning.

A control unit controls the cooling mechanism, the humidifier, and the chemical supply to provide a suitable temperature, relative humidity, and chemical agent content in the atmosphere for high quality printing without ink dry up. The control unit monitors the temperature, humidity, and chemical agent content of the atmosphere within the semi-enclosed space via respective temperature, humidity, and chemical agent sensors, and then selectively activates the cooling mechanism, the humidifier, and the chemical supply as a function of the sensor readings.

For example, if the printing unit is configured to print with a water based ink, then ink dry-up can be controlled by controlling the evaporation of ethanol amine (or, for example, another organic amine compound or ammonia) from the ink. The evaporation of ethanol amine from the ink, in turn, can be prevented by injecting a sufficient amount of ethanol amine into the atmosphere within the semi enclosed space to prevent the evaporation of the ethanol amine from the ink. As an illustration, at 85 percent relative humidity and 93 degrees Fahrenheit, a concentration of 300–20,000 parts per million of ethanol amine (or ammonia) in the atmosphere will provide acceptable printing conditions for a water based ink containing 2% ethanol amine (or ammonia).

In certain cases where the volume of the semi-enclosed space is small and relatively well sealed, and the printing unit components enclosed within the semi-enclosed space generate little heat, there will be no need for a cooling mechanism, humidifier or chemical supply. In such a case, the gases in the atmosphere will quickly come to equilibrium locally near the ink transferring parts to prevent ink dry-up.

In accordance with a second embodiment of the present invention, the walls of the housing are hollow, and the cooling mechanism includes a cooling inlet and a cooling outlet, each connected to the hollow interior of the walls of the housing. A cooling agent, e.g. cold water or air, is circulated through the hollow interior of the housing, entering via the cooling inlet and exiting through the cooling outlet. The cooling agent lowers the temperature of the housing, which, in turn, lowers the temperature within the semi-enclosed space. In addition, the outer surface of the housing is insulated so that the air within the semi-enclosed space surrounded by the inner surface of the housing remains cold. A cooling valve, which is coupled either to the cooling inlet or the cooling outlet, is selectively actuated by the control unit as a function of one or more of the sensor outputs to control the cooling of the semi-enclosed space.

In accordance with a third embodiment of the present invention, the chemical supply includes a reservoir, a liquid solution containing the chemical agent (e.g., ethanol amine, another organic amine compound, or ammonia, in solution) and a heating element. In accordance with this embodiment, the control unit can increase the chemical agent content of the atmosphere by activating the heating element, thereby causing more of the chemical agent in the solution to evaporate. Preferably, the heating element is located relatively close to the reservoir.

In accordance with a fourth embodiment of the present invention, the chemical supply includes a gas intake connected to a supply mechanism for supplying the chemical agent in gaseous form. A valve is mounted between the gas intake and the supply mechanism, and controlled by the control unit.

The present invention can be used with a variety of ink types, including, for example, water based inks, oleoresinous inks (containing hydrocarbons in the 270° F. boiling range, e.g. Magee oils), aclylate inks cured by radiation, and high viscosity inks known as paste inks. Preferably, the present invention uses a water based paste ink which does not contain any volatile organic components (VOCs) so that the enclosed atmosphere is not subject to explosion. In accordance with the present invention, the chemical used as a pH increaser or drying prevention agent in the ink is prevented from evaporation by applying a chemical to the atmosphere in the semi-enclosed area within the housing. Preferably, the chemical applied to the atmosphere is the same chemical which serves as the pH increaser or drying prevention agent in the ink. For example, in a water based ink which uses ethanol amine as a pH increaser, ethanol amine can be added to the atmosphere in the semi-enclosed area to prevent ink dry-up. If the amount of ethanol amine in the atmosphere causes the partial pressure of the ethanol amine in the atmosphere to be equal to the vapor pressure of the ethanol amine in the ink, then the ethanol amine will not evaporate from the ink into the atmosphere.

If the chemical agent is the same chemical as the substance in the ink, the chemical agent can not only be used to prevent drying or precipitation of resin from the ink as described above, but also may serve as a pH increaser by increasing the amount of the substance in the ink. For example, if the substance in the ink is ethanol amine, an increase in the amount of ethanol amine in the ink will increase the pH of the ink, thereby reducing drying or precipitation of resins and solvents in the ink. If the amount of ethanol amine in the atmosphere causes the partial pressure of the ethanol amine in the atmosphere to be greater than the vapor pressure of the ethanol amine in the ink, then the ethanol amine will flow from the atmosphere into the ink, thereby increasing the amount of the ethanol amine in the ink, and the pH of the ink.

In accordance with a preferred embodiment of the present invention, a printing unit is provided for printing with water-based inks. Such water-based inks provide many advantages over conventional inks, but have proven difficult to use in an offset printing unit. Preferably, the present invention uses a water-based ink which is free of volatile organic components (VOCs). VOCs, such as hydrocarbons, are conventionally evaporated from inks in long driers. As a result, VOC-free water-based inks dry cleaner, with little or no air pollution. Moreover, since these water-based inks have no VOCs to evaporate, they require less temperature to dry. This, in turn, allows a reduction in the length of the driers. Finally, with the use of water-based inks with no VOCs, alternative drying mechanisms such as infra red or micro-wave drying are possible in offset presses. However, it has been found that water-based inks are difficult to use in offset printing because the ink is highly sensitive to temperature and humidity variations, and tends to dry prematurely.

In accordance with a preferred embodiment of the present invention, a printing unit for printing with water based inks includes a blanket cylinder for supporting a printing blanket, a print cylinder for supporting a print form, and an inking unit for applying a water-based ink over the print form. The printing blanket, print form, and inking unit each have respective ink carrying surfaces for transferring the water-based ink. A cooling unit is mounted within the printing unit for maintaining the outer ink carrying surface of one or more of the print form, printing blanket, and inking unit at a predetermined level. Since heating and cooling above the dew point will not result in condensation, the predetermined temperature level is preferably set above the dew point of the atmosphere surrounding the ink carrying surfaces to prevent condensation of the water in the atmosphere onto the ink carrying surfaces. Moreover, in accordance with a preferred embodiment of the invention, the predetermined temperature level is set just slightly above the dew point so that evaporation of water from the ink is minimized while still preventing condensation.

In accordance with another embodiment of the present invention, the cooling unit includes a blanket cylinder cooling unit coupled to the blanket cylinder for circulating a first cooling agent through the blanket cylinder. In addition, a blanket temperature sensor is mounted within the printing unit for monitoring the temperature at the outer ink carrying surface of the printing blanket, and a control unit is provided which has an input connected to the blanket temperature sensor, and an output connected to the blanket cylinder cooling unit. The control unit monitors the temperature at the outer ink carrying surface of the printing blanket via the blanket temperature sensors, and controls the temperature at the outer ink carrying surface of the printing blanket by controlling the temperature of the first cooling agent.

In accordance with another embodiment of the present invention, the cooling unit may include a print cylinder cooling unit alone or in combination with the blanket cylinder cooling unit described above. The print cylinder cooling unit is coupled to the print cylinder for circulating a second cooling agent through the print cylinder. A print form temperature sensor is mounted within the printing unit for monitoring the temperature at the outer ink carrying surface of the print form, and the control unit has an input connected to the print form temperature sensor, and an output connected to the print cylinder cooling unit. The control unit monitors the temperature at the outer ink carrying surface of the print form via the print form temperature sensor, and controls the temperature at the outer ink carrying surface of the print form by controlling the temperature of the second cooling agent.

In addition, the cooling unit may also include an inker cooling unit alone or in combination with the print cylinder and blanket cylinder cooling units described above. The inker cooling unit is coupled to one or more of a plurality of rollers within the inking unit (e.g., vibrator rollers) and circulates a third cooling agent through these rollers. A inking unit temperature sensor is mounted within the printing unit for monitoring the temperature at the outer ink carrying surface of the rollers, and the control unit has an input connected to the inking unit temperature sensor, and an output connected to the inker cooling unit. The control unit monitors the temperature at the outer ink carrying surface of the rollers via the inking unit temperature sensor, and controls the temperature at the outer ink carrying surface of the rollers by controlling the temperature of the third cooling agent.

In accordance with a further embodiment of the present invention, an air blower is mounted within the printing unit for circulating and conditioning the atmosphere surrounding the blanket cylinder, print cylinder, and/or inking unit. While the air blower may be used independently from the cooling unit, in accordance with a preferred embodiment of the present invention, the air blower is used in combination with the cooling unit described above.

In accordance with a further embodiment of the present invention, the features of the invention may be incorporated into a printing unit which allows sheet-feeding of material into the press. A feed table may be used to feed a stack of sheets to a suction head, which feeds individual sheets to the printing unit, which may include the features described above.

BRIEF DESCRIPTION OF THE DRAWINGS

FIG. 8(*a*) shows an illustrative flow chart for the control unit of FIG. 8.

FIG. 9, 9(*a*) show devices for controlling a temperature of the side walls of a printing unit.

DETAILED DESCRIPTION OF THE INVENTION

Figure 1:
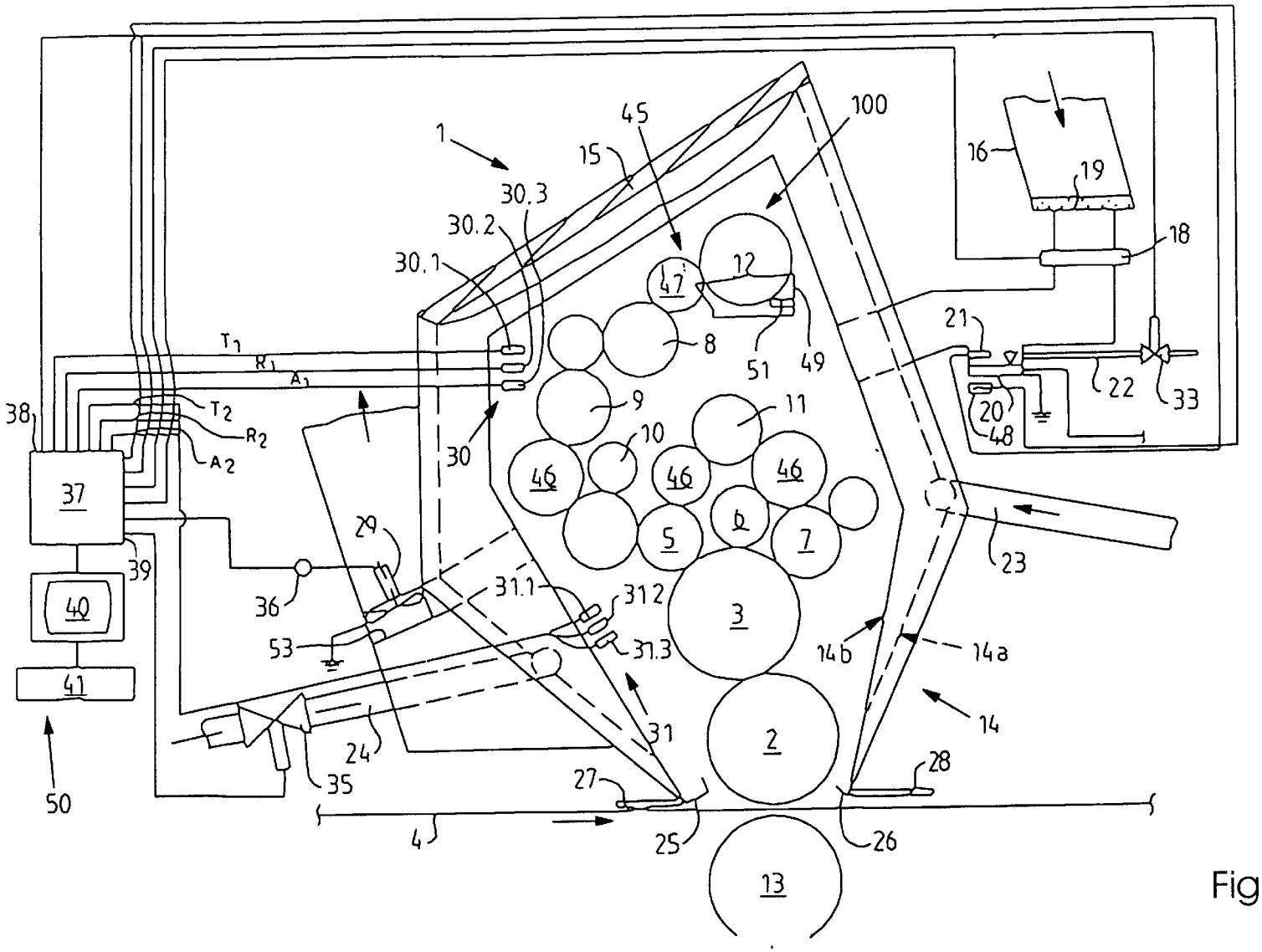
FIG. 1 shows a printing unit according to the present invention.

FIG. 1 shows a printing unit 1 according to the present invention for preventing premature dry-up of ink. The printing unit 1 of a rotary printing press includes an upper inking unit 45, an upper print cylinder 3 and an upper blanket cylinder 2, which cooperate to print ink onto an upper side of a web of material 4. A cylinder 13 is shown below the web 4. A print form suitable for printing with inks (for example, water based inks) is mounted on the print cylinder 3. If the printing unit 1 is configured as a non-perfecting press, the cylinder 13 is an impression cylinder. If the printing unit 1 is configured as a perfecting press, the cylinder 13 is a blanket cylinder and the printing unit 1 includes a corresponding lower inking unit and lower print cylinder (not shown).

The inking unit 45 includes an ink fountain roller 12 supplying the ink (e.g., water based ink) to rollers 5–11, 46–47 of the inking unit 45. By splitting the ink film on each surface of each of the respective rollers 8–11, 46, a thin film of ink is supplied to the surface of form rollers 5, 6, 7. A first form roller 5, a second form roller 6 and a third form roller 7 apply the thin film of ink onto the surface of the print form(s) which are mounted on the surface of the print cylinder 3. Along the path the film of ink takes through the respective roller surfaces of the inking unit of the printing unit 1, there is arranged a metering roller 47, a plurality of distribution rollers 8, 9, 11, and a plurality of vibrator rollers 46. Naturally, the number, type, and arrangement of rollers in the inking unit 45 can be different from the arrangement of FIG. 1.

The print form may be configured as a flat printing plate mounted on the surface of the print cylinder 3 by its leading and trailing edges, or as a sleeve shaped print form mounted axially over the print cylinder. Over the circumference of the blanket cylinder 2 there can either be arranged a conventional flat rubber blanket or a sleeve-shaped printing blanket. The blankets and print forms can be installed and removed in any conventional manner.

The inking unit 45 of the printing unit 1 and the printing unit cylinders 2, 3 are encapsulated within a housing 14. The inking unit 45 (including rollers 5–12, 46–47), the cylinders 2,3, and the housing 14 are supported by sidewalls (not shown). The housing 14 forms a semi-enclosed area 100 around the ink unit 45 and the cylinders 2,3. Preferably, the housing 14 forms a semi-enclosed area around the inking unit 45, and print 2 and blanket 3 cylinders, as shown. However, it is also possible to configure the housing to form a semi-enclosed area only around the inking mechanism 45 and print cylinder 2; only around the inking mechanism 45; or only around the print cylinder 2. In a perfecting press, the housing 14 could also be constructed around the lower inking unit, plate and blanket cylinders.

The housing 14 is hollow and has an outer wall 14*a* and an inner wall 14*b*. An insulating material 15 surrounds the outer wall 14*a*. An air intake 16 extends from the outside the housing 14 through the inner wall 14*b*. In order to provide fresh air to the semi-enclosed area 100 of the housing 14 and to the rollers 5–11, 46–47 and cylinders 2,3, air passes through an air filter 19 mounted within the air intake 16 and into the semi-enclosed area 100. A humidifier 18 is mounted below the air filter 19 for controlling the humidity within the semi-enclosed area. The humidifier 18 is coupled to, and controlled by, a control unit 37. An air exhaust 53 also extends from outside the housing 14 through the inner wall 14*b*. The air exhaust 53 includes an air blower 29 for exhausting air from the semi-enclosed area 100. The air blower 29 is also connected to, and controlled by, the control unit 37.

The air intake 16 further includes a reservoir 20 which is connected to a supply hose 22 and is grounded. The supply hose 22 includes a supply valve 33. Alternatively, the reservoir 20 could be located within the semi-enclosed area 100, or connected to the semi-enclosed area via a separate intake. The reservoir 20 contains an amount of a chemical agent, e.g,. ethanol amine, another organic amine compound, or ammonia, in a dilute solution. A sensor 21 is mounted within the reservoir for monitoring the level of the reservoir 20. Preferably, the level of the reservoir is periodically checked by the sensor 21 to provide a precise reading of the solution level.

A cooling inlet 23 and cooling outlet 24 each extend from outside the housing 14 through the outer wall 14*a*. A cooling agent, e.g. cold water or cold air, enters the hollow interior of the housing via the cooling inlet 23 and exits via the cooling outlet 24 to allow for temperature control over the housing 14 and consequently over the atmosphere which surrounds the rollers 4–11, 46–47 and cylinders 2,3. The flow of the cooling agent through the inlet 23 and outlet 24 can be adjusted by controlling valve 35 which can be mounted at the outlet 24, at the inlet 23, or at both the outlet and inlet. Preferably, the valve 35 is mounted at the outlet 24 as shown. The valve 35 is connected to, and controlled by, the control unit 37 for controlling the flow of the cooling agent through the hollow interior of the housing 14.

A first sensor set 30, including first sensors 30.1, 30.2, and 30.3, and a second sensor set 31, including second sensors 31.1, 31.2, 31.3, are arranged within the semi-enclosed area 100 of the housing 14. The first sensor set 30 is arranged adjacent to the inking unit 45 to monitor the atmosphere surrounding the inking unit 45. The second sensor set 31 is arranged adjacent to the cylinders 2, 3 to monitor the atmosphere surrounding the cylinders 2, 3. The first and second sensor sets 30, 31 are connected to the control unit 37. Each sensor set 30, 31 includes a respective temperature sensor 30.1, 31.1, a relative humidity sensor 30.2, 31.2, and a chemical agent (e.g., ethanol amine, other organic amine, or ammonia) sensor 30.3 and 31.3. It is understood that additional sensor sets can be mounted in key locations as necessary. Each of the sensors 30.1, 30.2, 30.3, 31.1, 31.2, 31.3 have respective output(s) which are individually connected to the control unit 37.

A central control system 50 includes the control unit 37. The control unit 37 includes an input 38 for receiving input from the sensors 30, 31 and an output 39 for controlling the air blower 29, the humidifier 18, the supply valve 33, and the cooling outlet valve 35. A display 40 and keyboard 41 are connected to the control unit 37 to allow a press operator to monitor the status of the sensors and to control the state of the valves and the air blower.

In order to provide optimum printing conditions, and to prevent premature ink dry-up, the control unit maintains the temperature, relative humidity, and chemical agent content of the atmosphere within the semi-enclosed area within desired ranges. The precise temperature and humidity levels, and the type and amount of chemical agent may vary depending on the type of ink and the location within the housing. The present invention can be used with a variety of ink types, including, for example, water based inks, oleo-resinous inks (containing hydrocarbons in the 240–320° F. boiling range, e.g., Magee oils), acrylate inks cured by radiation, and high viscosity inks known as paste inks. Preferably, the present invention uses a water based ink, which does not contain any volatile organic components (VOCs). In general, the temperature should be kept within a temperature range which is high enough to promote good ink transfer, and low enough to prevent toning. The relative humidity, in turn, should be low enough to prevent condensation, but high enough to minimize evaporation of water from the ink. In order to prevent premature ink dry-up, the amount of chemical agent in the atmosphere should be sufficient to reduce the evaporation of the chemical substance acting as a pH increaser or drying prevention agent in the ink. The amount of chemical agent needed, in turn, is a function of the nature of the chemical agent, the nature of the chemical substance in the ink, the relative humidity, and the temperature of the atmosphere within the semi-enclosed area 100 adjacent to the ink transferring surfaces. The desired levels for the temperature, humidity, and chemical agent can be empirically determined through testing various temperature, humidity, and chemical agent levels with the desired ink.

In accordance with the illustrative embodiment of the present invention shown in FIG. 1, a press operator inputs a desired temperature level, relative humidity level, and chemical agent level for the printing unit 1 to the control unit 37 via the keyboard 41. The control unit 37 monitors the outputs of the temperature sensors 30.1, 31.1, the relative humidity sensors 30.2, 31.2, and the chemical agent sensors 30.3, 31.3. If the control unit determines that the temperature is above the desired level, it will open the cooling outlet valve 35 and circulate the cooling agent through the hollow interior of the housing 14, thereby cooling the atmosphere within the semi-enclosed area 100, e.g., by conduction, convection, and radiation. Once the temperature drops below the desired temperature level, the valve 35 will be closed. As a result, the temperature in the semi-enclosed area 100 will continually oscillate about the desired temperature level. Similarly, if the control unit determines that the humidity is below the desired level, it will activate the humidifier thereby adding moisture to the air traveling through the air intake 16 into the semi-enclosed area 100, and increasing the humidity of the atmosphere within the semi-enclosed area 100. Once the humidity rises above the desired humidity level, the humidifier will be turned off As a result, the humidity in the semi-enclosed area 100 will continually oscillate about the desired humidity level. Finally, if the control unit determines that the chemical agent level is below the desired level, it will activate a heater 48 thereby causing the chemical agent in the reservoir to evaporate from the solution more quickly into the air passing through the air intake 16 to the semi-enclosed area and increasing the chemical agent content of the atmosphere within the semi-enclosed area 100. Once the chemical agent level rises above the desired level, the heater 48 is turned off. As a result the chemical agent content in the semi-enclosed area will continually oscillate about the desired level.

The present invention will now be described in more detail with regard to water based inks. The print form is suitable for receiving and transferring an image using water based inks. It has been found that "waterless" type printing plates, such as those manufactured by Toray Industries, or those described in U.S. Pat. No. 5,370,906 to Danker are also suitable for printing with water based inks. As an example, a Toray Industries printing plate having an aluminum oxide substrate with an image area coated with a photopolymer whose surface is hydrophilic in nature and a non-image area coated with a silicone polymer may be used.

An illustrative water-based ink for use with the present invention may include the components set forth below. The water phase of the ink is supplied by the water present in the acrylic resin latex, hydroxypropyl cellulose, hydroxyethyl ethylene urea, and the maleated rosin ester. The pH increaser in the ink is supplied by the ethanol amine:

| Component | Amount, wt. % |
|---|---|
| Styrene/maleic anhydride resin | 12 |
| Phthalocyanine Blue pigment | 12 |
| Acrylic resin latex (50% wt. % solids) | 5 |
| Hydroxypropylcellulose (3% wt. % solids) | 10 |
| Hydroxyethylethylene urea (70% wt % solids) | 8 |
| Monoethanol amine | 2 |
| Polyethylene Wax | 2 |
| Ethoxylated acetylenic diol surfactant | 2 |
| Maleated rosin ester (50% wt. % solids) | 47 |
| Total | 100 |

In order to provide optimum conditions for the printing with water based inks, and to prevent the ink from drying prematurely in the inking unit or cylinders, the relative humidity, temperature, and ethanol amine level within the semi-enclosed area 100 in the housing 14 are maintained at certain predetermined levels. For example, in a water based ink containing 2% ethanol amine, it has been found that by providing an atmosphere containing 300 to 20,000 parts per million of ethanol amine at a temperature of 93–95° F. and a relative humidity between 75% and 95%, high print quality can be maintained. Naturally, these levels are merely illustrative, and may vary in accordance with a number of factors including the particular construction of the printing unit, the particular composition of the water based ink, print form and paper being used. The temperature, relative humidity, and ethanol amine levels are monitored by the control unit, and the atmosphere within the semi-enclosed area 100 is maintained within the desired temperature, relative humidity, and ethanol amine level ranges by selectively activating the cooling outlet valve 35, the heater 48, and the humidifier 18 as described above.

When a printing press is first started, the printing unit components 2,3, 5–12, 14–15, 46–47 will be relatively cold. Therefore, the control unit 37, by monitoring the temperature sensors 30.1, 31.1, will determine that the temperature within the semi-enclosed area 100 is below the desired temperature level for the water based ink, print form, and paper being used. The control unit 37 will then display a message on the display 40 advising the press operator to pre-heat the printing unit 1 prior to printing. Such a pre-heating could be accomplished by running the press while off impression until the temperature within the semi-enclosed area 100 has reached the desired level. Alternatively, a heating element (not shown) could be arranged within the semi-enclosed area to pre-heat the atmosphere, and controlled via the control unit 37 .

In contrast, after the printing press has been printing for a period of time, the temperature within the printing unit 1 may rise above the desired temperature level. The control unit 37, by monitoring the temperature sensors 30.1, 31.1, will determine that the temperature within the housing 14 is above the desired temperature level for the water based ink, print form, and paper being used, and will then lower the temperature within the semi-enclosed are by opening the cooling outlet valve 35 as described above.

The rise in temperature caused by operation of the press may also affect the relative humidity within semi-enclosed area 100 of the housing 14. For example, an increase in temperature results in a decrease in relative humidity, thereby causing the atmosphere surrounding the surface of the rollers carrying the ink film to become too dry. This, in turn, causes evaporation of ethanol amine and water from the ink. The control unit 37, by monitoring the humidity sensors 30.2, 31.2, or additional sensors placed in critical areas, will determine that the humidity within the housing 14 is below the desired level for the water based ink being used. Upon determining that the humidity is below the desired level, the control unit will increase the humidity by controlling the humidifier 18 as described above.

As discussed above, the percentage of ethanol amine in the air within the semi-enclosed area 100 of the housing 14 will also affect ink dry-up. The control unit 37, by monitoring the sensors 30.3, 31.3, will determine that the ethanol amine level within the housing 14 is below the desired level for the water based ink being used. The control unit 37 can then increase the ethanol amine level in the atmosphere by activating the heater 48. If the ethanol amine level rises above acceptable levels, the amount of ethanol amine in the semi-enclosed area within the housing 14 can be decreased by activating the air blower 29 to remove the excess ethanol amine from the semi-enclosed area.

FIGS. 2*a–e* show illustrative flow charts for the control unit 37 of FIG. 1. The control unit 37 monitors the output of the sensors and compares them to various set point values and alarm values as set forth below. Based upon these comparisons, the control unit 37 controls the valves 33, 35, the humidifier 18, the air blower 29, and the heater 48. The above referenced flow charts, however, are merely illustrative, and could be replaced with any suitable algorithm known in the art for matching a measured value to a desired value. For example, while the flow charts of FIGS. 2*a–e* may result in measured values which oscillate about the desired value, it is contemplated that other known closed loop control algorithms can be used which would reduce or eliminate these oscillations. It is further understood that additional sensors and control devices can be added to control the temperature, humidity, and chemical agent concentration more locally to provide for control over local variation in the humidity, temperature, chemical substance levels. For example, since the gear side of a printing press generally gets hotter than the work side of the printing press, it may be desirable to separately monitor the gear and work sides of the press, and to control them accordingly.

Referring to FIGS. 2(*a, e*), the control unit 37 maintains a set point$_R$ and alarm$_R$ level which establish a minimum and maximum relative humidity value for the atmosphere within the semi-enclosed area 100; a set $point_T$ and $alarm_T$ level which establish a minimum and maximum temperature value for the atmosphere within the semi-enclosed area 100; and a set $point_A$ and $alarm_A$ level which establish a minimum and maximum ethanol amine level for the atmosphere within the semi-enclosed area 100. These alarm and set point levels are selected as a function of the particular ink being used. For example, for a water based ink containing 2% ethanol amine, the following set points and alarms have been found to be effective for controlling the atmosphere within the semi-enclosed area:

set $point_T$=93 degrees Fahrenheit
$alarm_T$=98 degrees Fahrenheit
set $point_R$=75%
$alarm_R$=95%
set $point_A$=300 parts per million
$alarm_A$=20,000 parts per million Moreover, additional alarm values may also be useful. For example, extremely low relative humidity, e.g., below 35%, may increase the likelihood of a web break due to the high tack of the ink at low humidity. Therefore, an additional relative humidity alarm could be triggered by the relative humidity dropping below 35%.

Figure 2A:
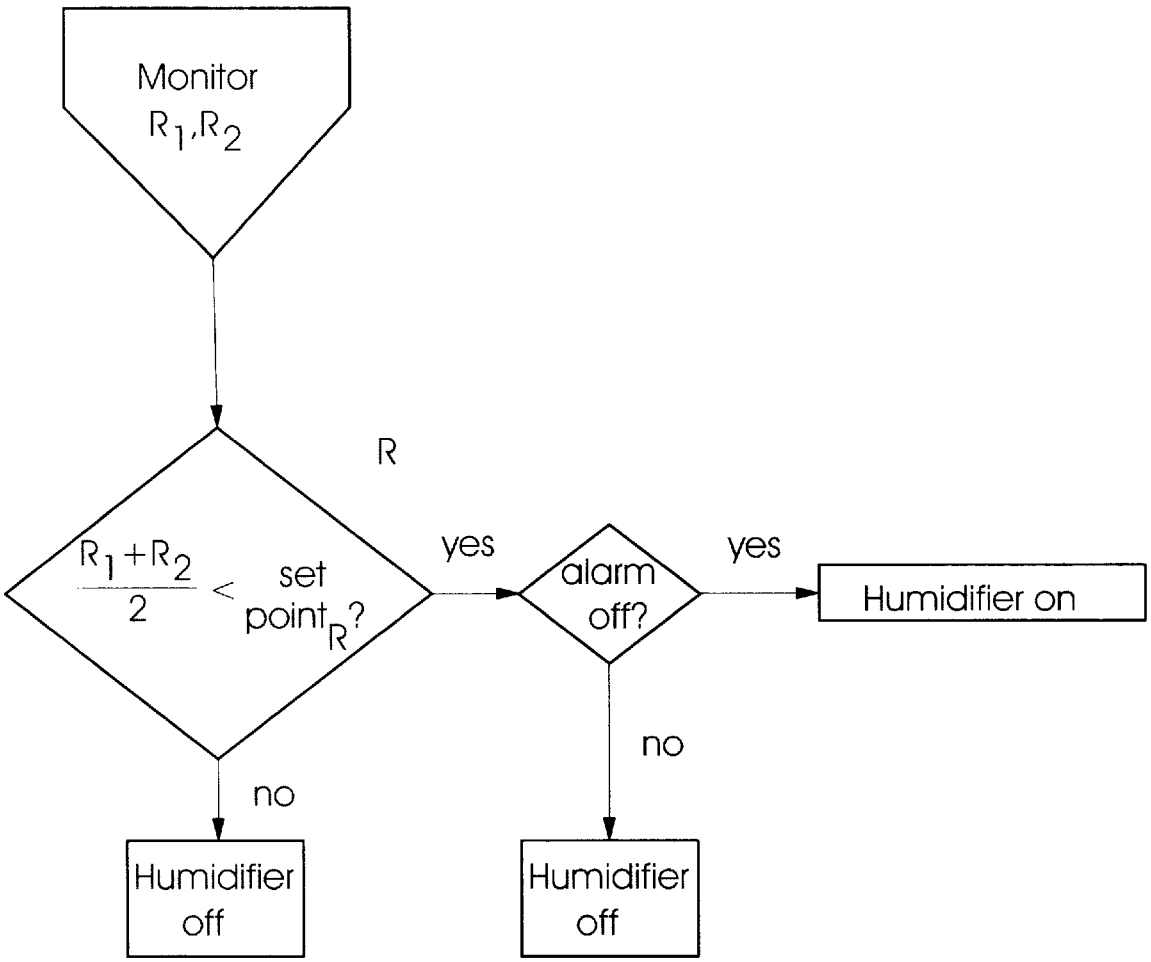
FIGS. 2*a–e* show flow charts for a control unit of the printing press of FIG. 1.
Figure 2B:
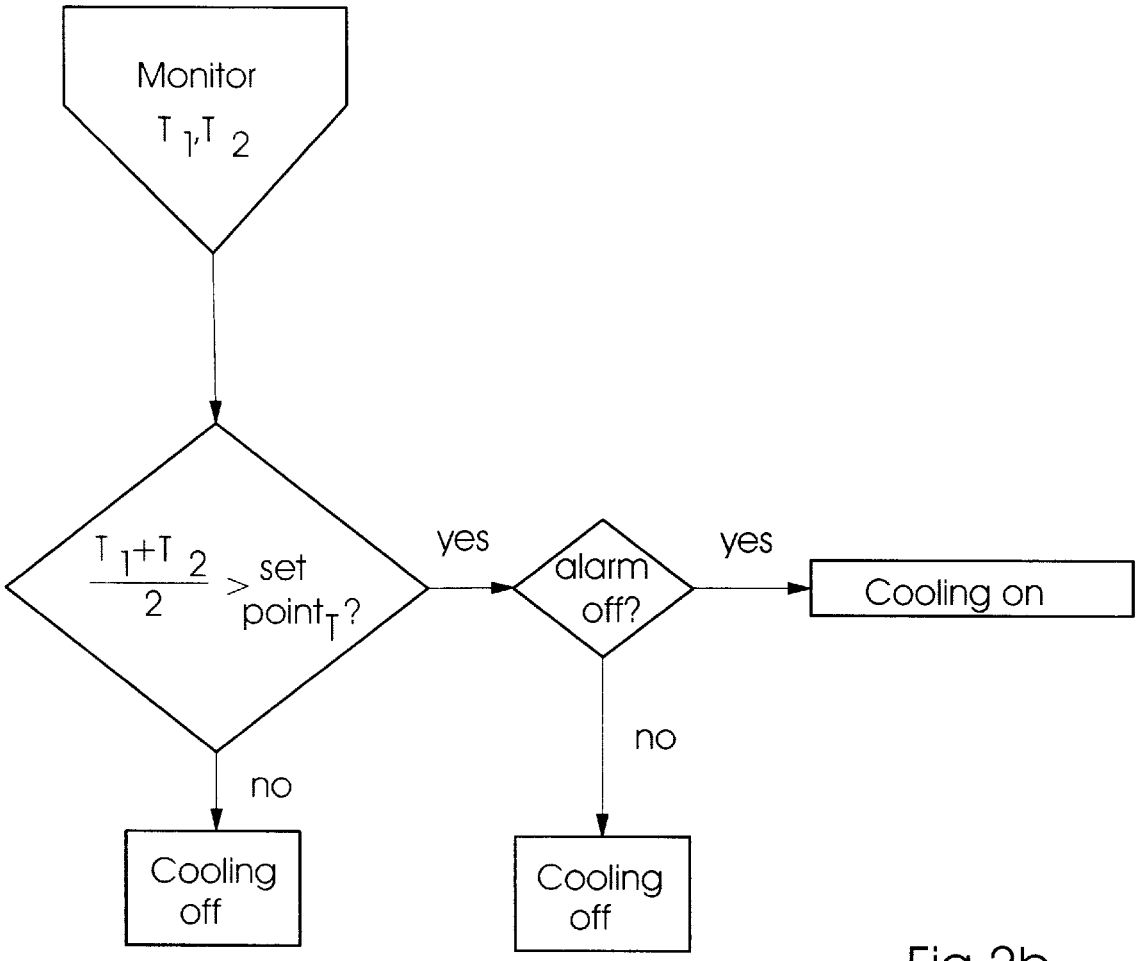
Figure 2C:
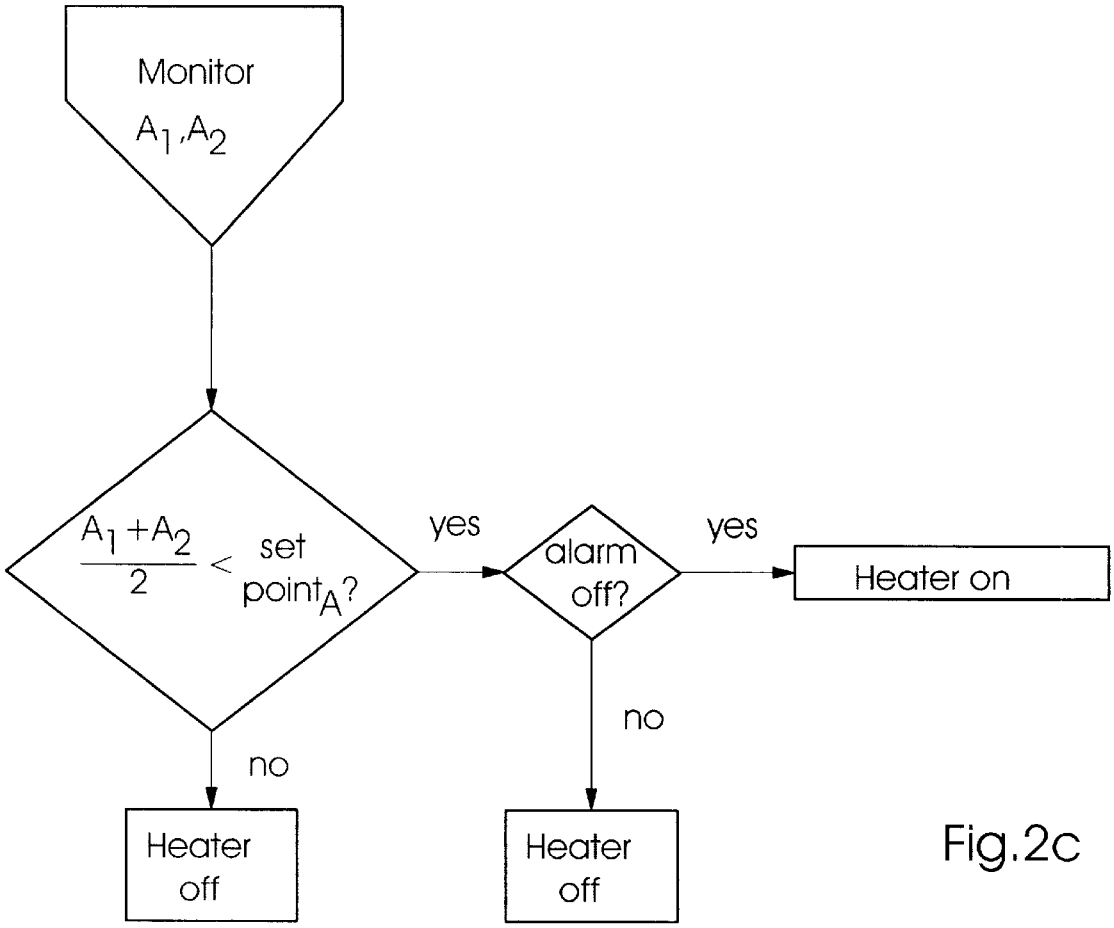
Figure 2D:
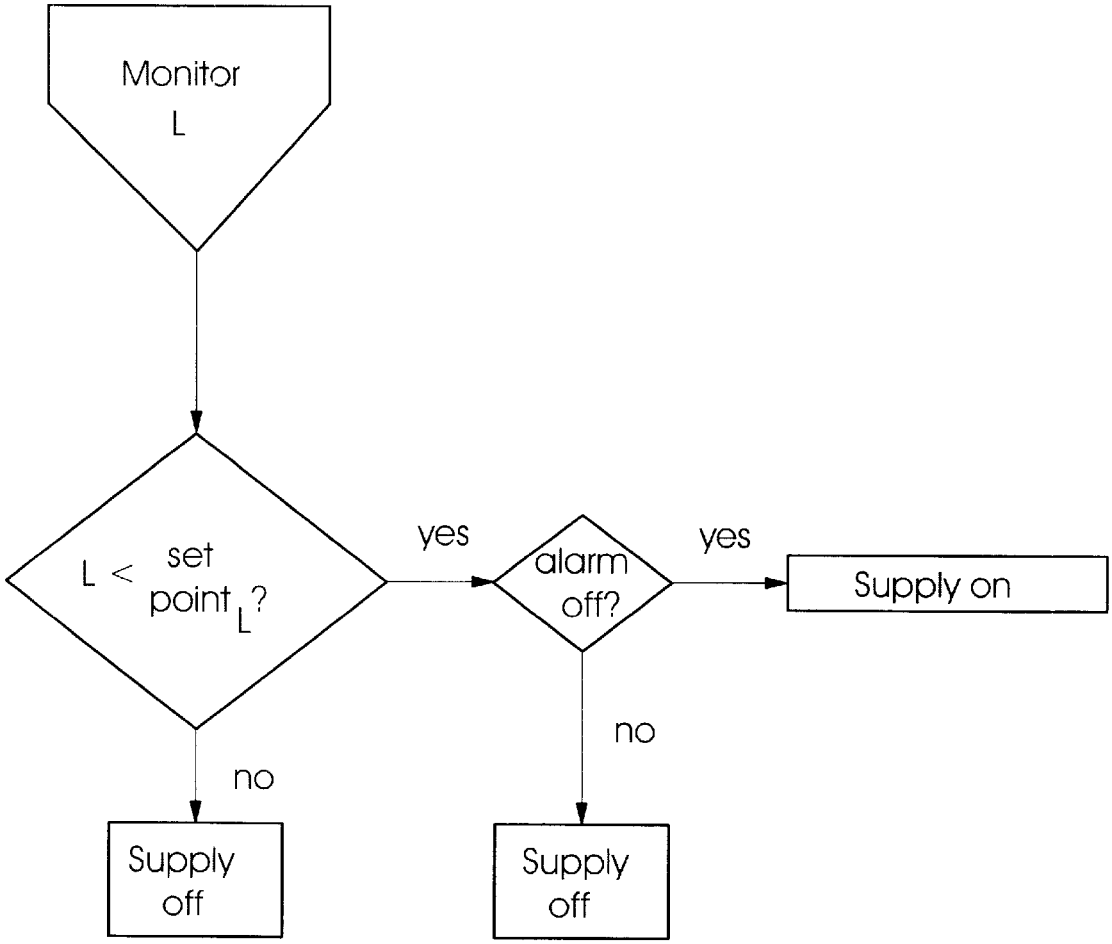
Figure 2E:
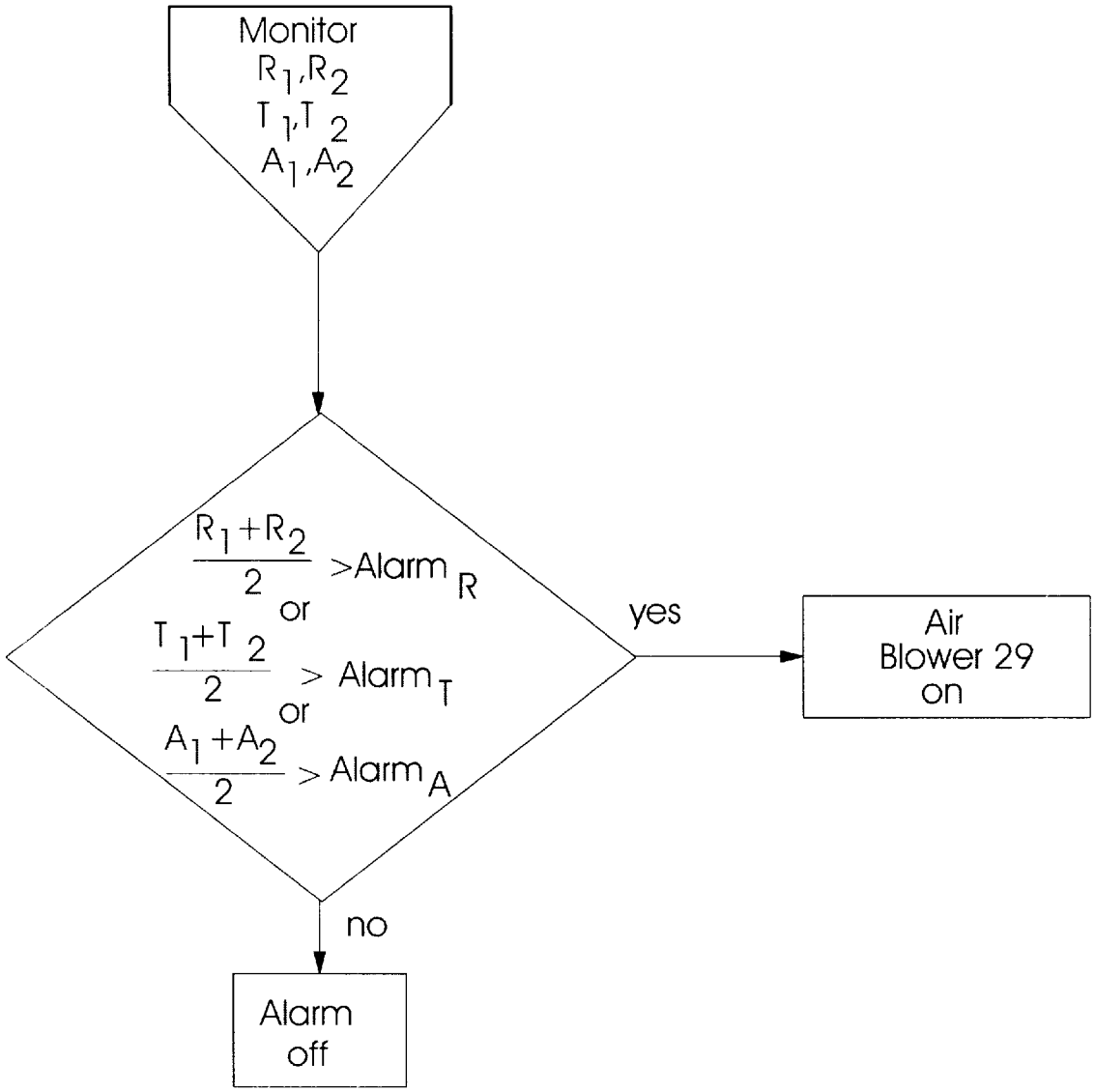

As shown in FIG. 2*e*, if the average of any one of the humidity levels $(R_1+R_2)/2$, the temperature levels $(T_1+T_2)/2$ or ethanol amine levels $(A_1+A_2)/2$ exceed their respective alarm levels ($alarm_R$, $alarm_T$, $alarm_A$), then the air blower 29 is activated to expel the atmosphere from the semi-enclosed area 100 of the housing 14, and all other valves 32–35 are closed, and the heater 48 is turned off.

Referring to FIG. 2*a*, if the average of the relative humidity signals $(R_1+R_2)/2$ are below the set $point_R$ and there is no $alarm_{R,\ T,\ or\ A}$, the humidifier 18 will be turned on until the set $point_R$ is reached. Similarly, the cooling outlet valve 35 will be opened if there is no $alarm_{R,\ T,\ or\ A}$ and the average of the temperature signals $(T_1+T_2)/2$ are above the set $point_T$. If the average of the ethanol amine percentage signals $(A_1+A_2)/2$ is below the set $point_A$ and there is no $alarm_{R,\ T,\ or\ A}$, the heater is turned on until the set $point_A$ is reached.

In addition, the ethanol amine solution level (L) in the reservoir 20 can be checked via a level sensor 21. If the Level (L) is below a set $point_L$, and there is no $alarm_{R,\ T,\ or\ A}$, or A the supply valve 33 is turned on until the set $point_L$ is reached.

Moreover, a pH sensor 49 may be mounted within an ink pan 49 of the printing unit and connected to the control unit 37. It has been found that the tendency for an ink to dry prematurely is related to the pH level of the ink. Specifically, the lower the pH level of the ink, the lower the ethanol amine content of the ink, and the faster the ink will dry. The desired pH level can be set as a set point. If the pH reading is below the set $point_{pH}$, and there is no alarm $T_{R,\ T,\ or\ A}$, then the heater 48 will be turned on. The heat from the heater 48 will cause additional ethanol amine to evaporate from the reservoir 20 into the semi-enclosed space 100. Once the ethanol amine content of the atmosphere begins to exceeds its saturation point, some ethanol amine will flow out of the atmosphere into the ink on the rollers 5–12, 46, 47, and in the ink pan 49 thereby increasing the ethanol amine content of the ink and the pH of the ink. The pH sensor 49 may be used as a substitute for the ethanol amine sensor 30.3, or in addition to the ethanol amine sensor 30.3.

In accordance with another embodiment of the present invention, the humidifier and humidity sensor can be eliminated, and the humidity in the semi-enclosed space 100 can be controlled by adding an appropriate amount of water to the ethanol amine solution in the reservoir 20. Since the water in the ethanol amine solution will, like the ethanol amine, evaporate as a function of the temperature and relative humidity of the atmosphere in the semi-enclosed space, by selecting the proper ratio of water to ethanol amine in the ethanol amine solution, the humidity in the semi-enclosed space will be maintained within the desired range. While this approach provides the advantage of eliminating the humidifier and humidity sensor, it requires that more attention be paid to the composition of the ethanol amine solution.

Figure 3:
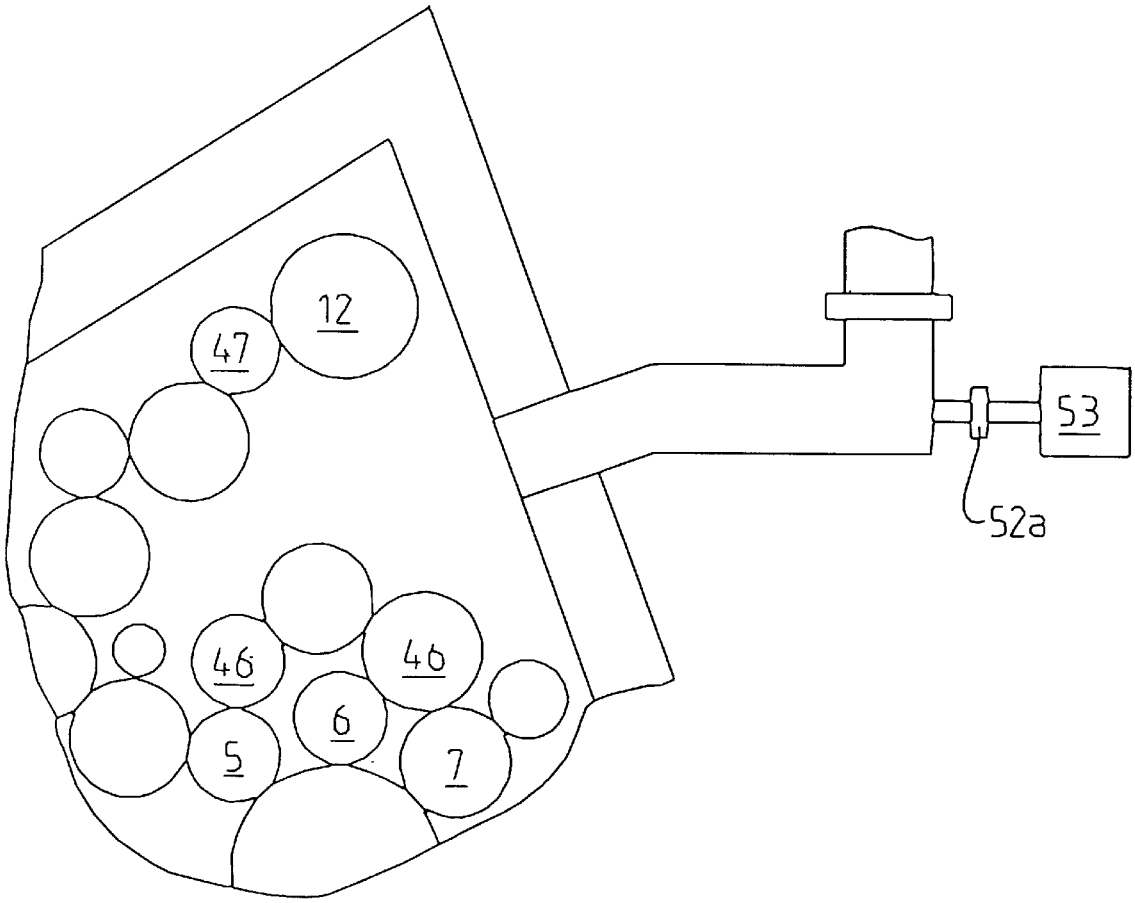
FIG. 3 shows an alternate embodiment of a chemical agent supply according to the present invention.

In accordance with an alternative embodiment of the present invention, and referring to FIG. 3, the reservoir 20 and heater 48 can be replaced with an ethanol amine gas inlet pipe 52 connected to a source of gaseous ethanol amine 53 through a valve 52*a*. In this embodiment, the ethanol amine content of the atmosphere can be increased by controlling the supply of ethanol amine gas into the semi-enclosed area 100.

Figure 4:
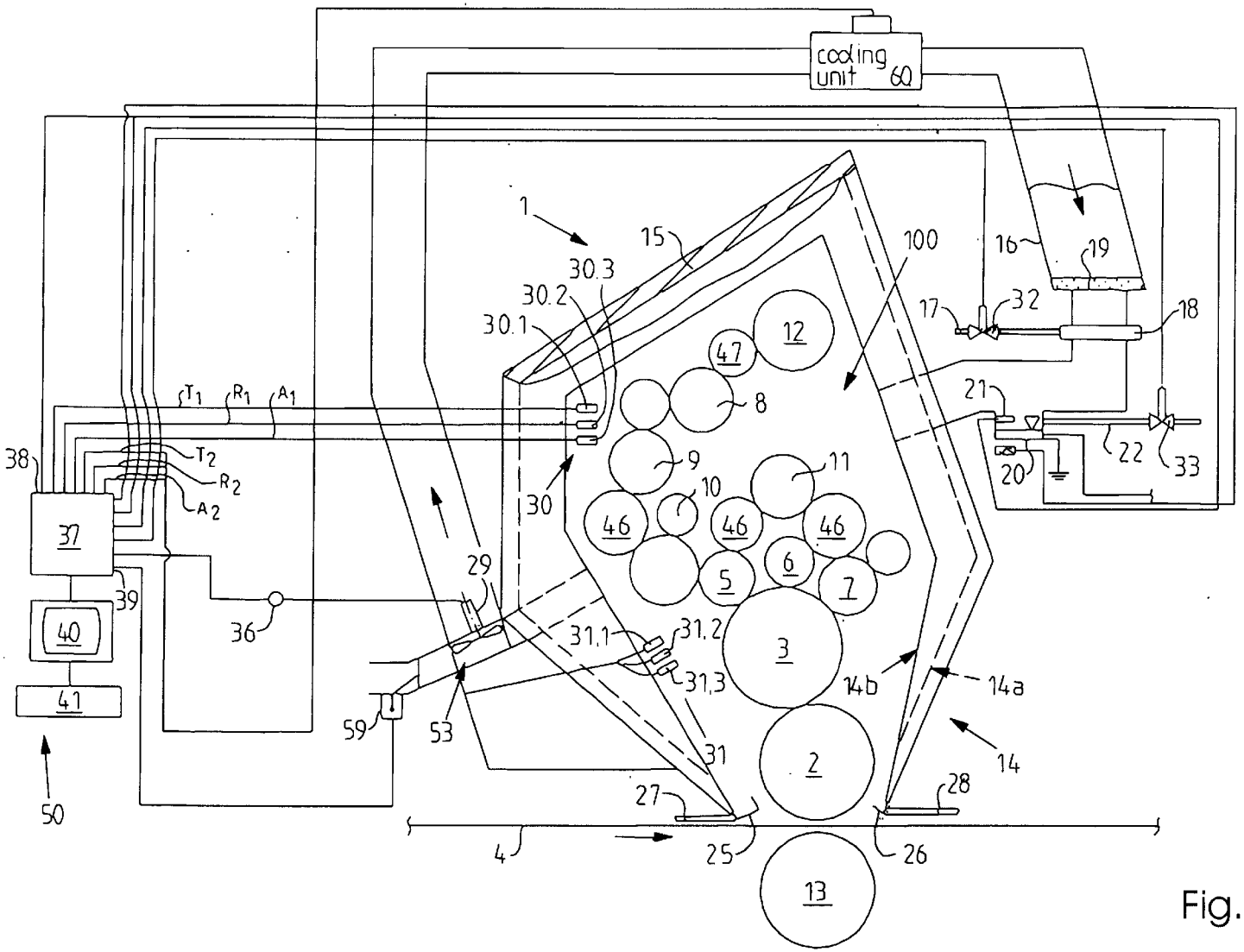
FIG. 4 shows an alternate embodiment of a cooling mechanism according to the present invention.

FIG. 4 shows another embodiment of the present invention. Similar components bear the identical reference numbers as FIG. 1. In accordance with this embodiment, a closed loop is formed between the air intake 16 and the air blower 29 and a cooling unit 60 is arranged in the closed loop between the air intake 16 and the air exhaust 53. The air blower 29 continuously circulates air out of the semi-enclosed area 100, through the cooling unit 60, the air filter 19, the humidifier 18, over the reservoir 20, and back into the semi-enclosed area 100. The humidifier 18 and heater 48 are activated as a function of the sensor outputs in the same manner as described above with regard to FIGS. 1–3. The cooling unit 60 replaces the cooling inlet 23 and cooling outlet 24 of FIG. 1 and is activated if the temperature in the semi-enclosed space 100 rises above the set $point_T$. If the average of any one of the humidity levels $(R_1+R_2)/2$, the temperature levels $(T_1+T_2)/2$ or ethanol amine levels $(A_1+A_2)/2$ exceed their respective alarm levels ($alarm_R$, $alarm_T$ $alarm_A$), then an exhaust valve 59 is opened to expel the atmosphere from the semi-enclosed area 100 of the housing 14, and the valves 32, 33, the heater 48, and the cooler 60 are disabled until all the levels have fallen below their alarm levels.

Figure 5:
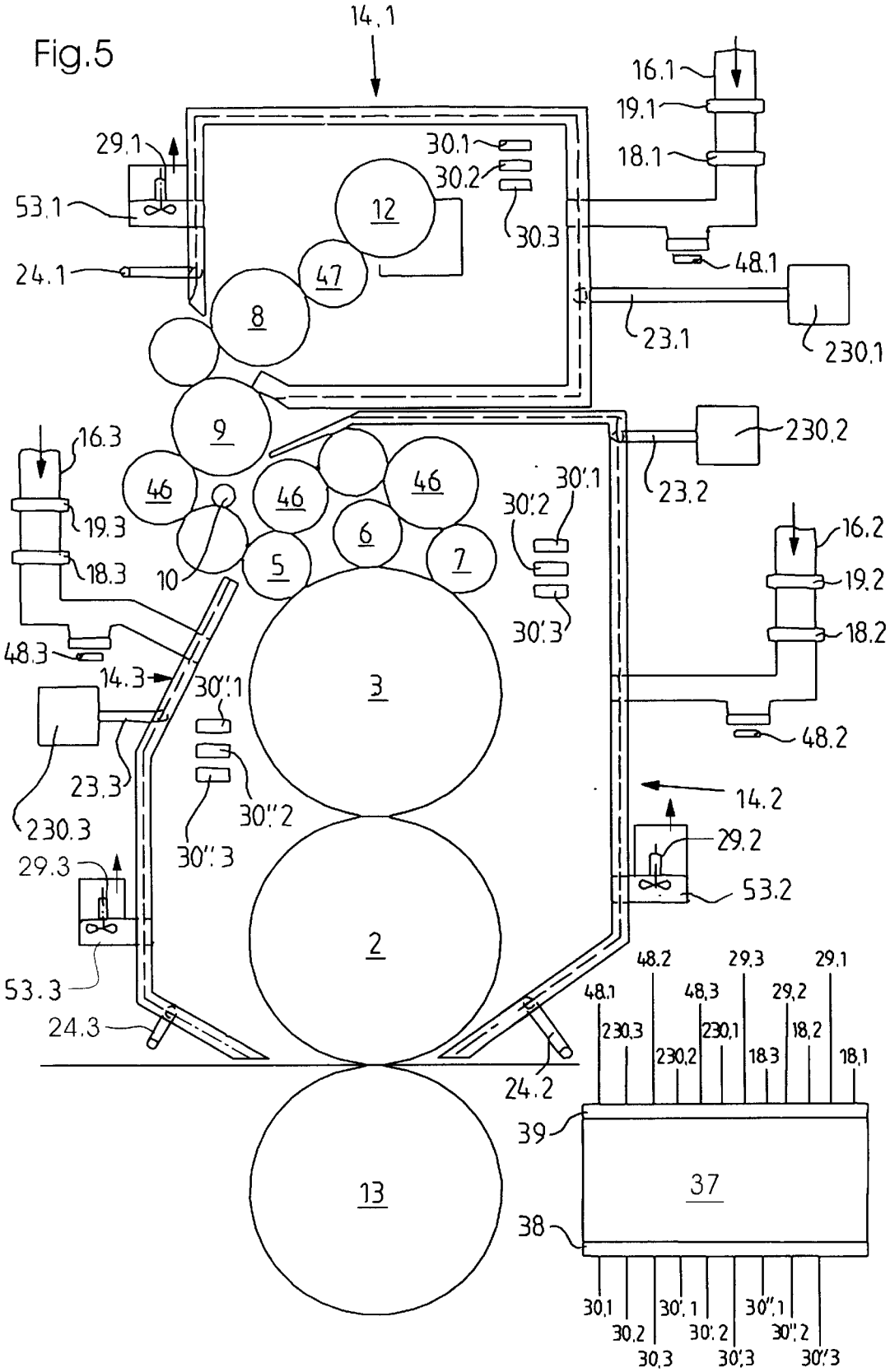
FIG. 5 shows a further embodiment of the present invention.

FIG. 5 shows an alternative embodiment of the present invention, with similar components bearing similar reference numerals to FIG. 1. A first sub-housing 14.1 having insulation 15.1 surrounds a fountain roller 12, a metering roller 47, and a distribution roller 8. A second sub-housing 14.2 having insulation 15.2 surrounds form rollers 5, 6, 7, vibrator rollers 46, and a back side of the print cylinder 3 and blanket cylinder 2. A third sub-housing 14.3 having insulation 15.3 surrounds a front side of the print cylinder 3 and blanket cylinder 2. Each sub-housing includes respective temperature (30.1, 30'.1, 30".1), humidity (30.2, 30'.2, 30".2), and chemical agent (30.3, 30'.3, 30".3) sensors for monitoring the atmosphere within the respective semi-enclosed areas 100.1, 100.2, 100.2. In addition, each housing includes respective cooling inlets 23.1, 23.2, 23.3 and cooling outlets 24.1, 24.2, 24.3 for circulating cooling agent through the housing 14.1, 14.2, 14.3. In addition, each sub-housing includes a respective air intake 16.1, 16.2, 16.3 including air filters 19.1, 19.2, 19.3, humidifiers 18.1, 18.2, 18.3, reservoirs 20.1, 20.2, 20.3, and heaters 48.1, 48.2, 48.3 for controlling the humidity and chemical agent levels in the atmosphere in the semi-enclosed areas 100.1, 100.2, 100.3. Finally, each sub-housing includes blowing devices 29.1, 29.2, 29.3 and air exhausts 53.1, 53.2, 53.3 for exhausting the atmosphere from the semi-enclosed areas 100.1, 100.2, 100.3. The control unit 37 includes respective inputs connected to the sensors (30.1, 30.2, 30.3, 30'.1, 30'.2, 30'.3, 30".1. 30".2, 30".3) and respective outputs connected to the cooling inlet (23.1, 23.2, 23.3), the humidifiers (18.1, 18.2, 18.3), the air blowers (29.1, 29.2, 29.3), the heaters (48.1, 48.2, 48.3). In accordance with this embodiment, the atmosphere within each semi-enclosed area (100.1, 100.2, 100.3) can be independently controlled. It should be noted that the subdivisions shown in FIG. 5 are merely illustrative. For example, in certain applications, it may be advantageous to provide separate sub-housings for the print cylinder and blanket cylinder, or to enclose the entire inking unit in a single sub-housing. It may be desirable to subdivide the enclosed space across the printing rolls so that side to side or middle variations inherent in the printing unit may be adequately compensated.

Independent control of several semi-enclosed areas provides several advantages. For example, since the semi-enclosed areas are smaller, there will be less variation in temperature, humidity, and ethanol amine levels across each semi-enclosed space. Moreover, since certain components of the printing unit may become hotter than others during press operation, it may be advantageous to control the atmosphere surrounding different components in separate control systems. In addition, it may be advantageous to provide different set point and alarm levels for different sub-housings. For example, since the ink film on the ink carrying surfaces of the fountain roller 12, metering roller 47, and distribution roller 8 is thicker than the ink film on the distribution rollers 5,6,7, and print cylinder 3, evaporation of ethanol amine and water may be of less concern in sub-housing 14.1 than in sub-housings 14.2 and 14.3. Therefore, a press operator might wish to set the humidity and ethanol amine set points for sub-housing 14.1 lower than in sub-housings 14.2 and 14.3. In this manner, a different set point and alarm can be set for the front side of the print and blanket cylinders than for the fountain roller 12, metering roller 47 and distribution roller 8.

In accordance with further embodiments of the present invention, cooling units can be provided for circulating a cooling agent through one or more of the print cylinders, blanket cylinders, vibrator rollers, and fountain rollers of the printing unit. By controlling the circulation of cooling agent through one or more of the cylinders and rollers, additional control over the temperature of the ink carrying surfaces of the cylinders and rollers can be obtained.

Figure 6:
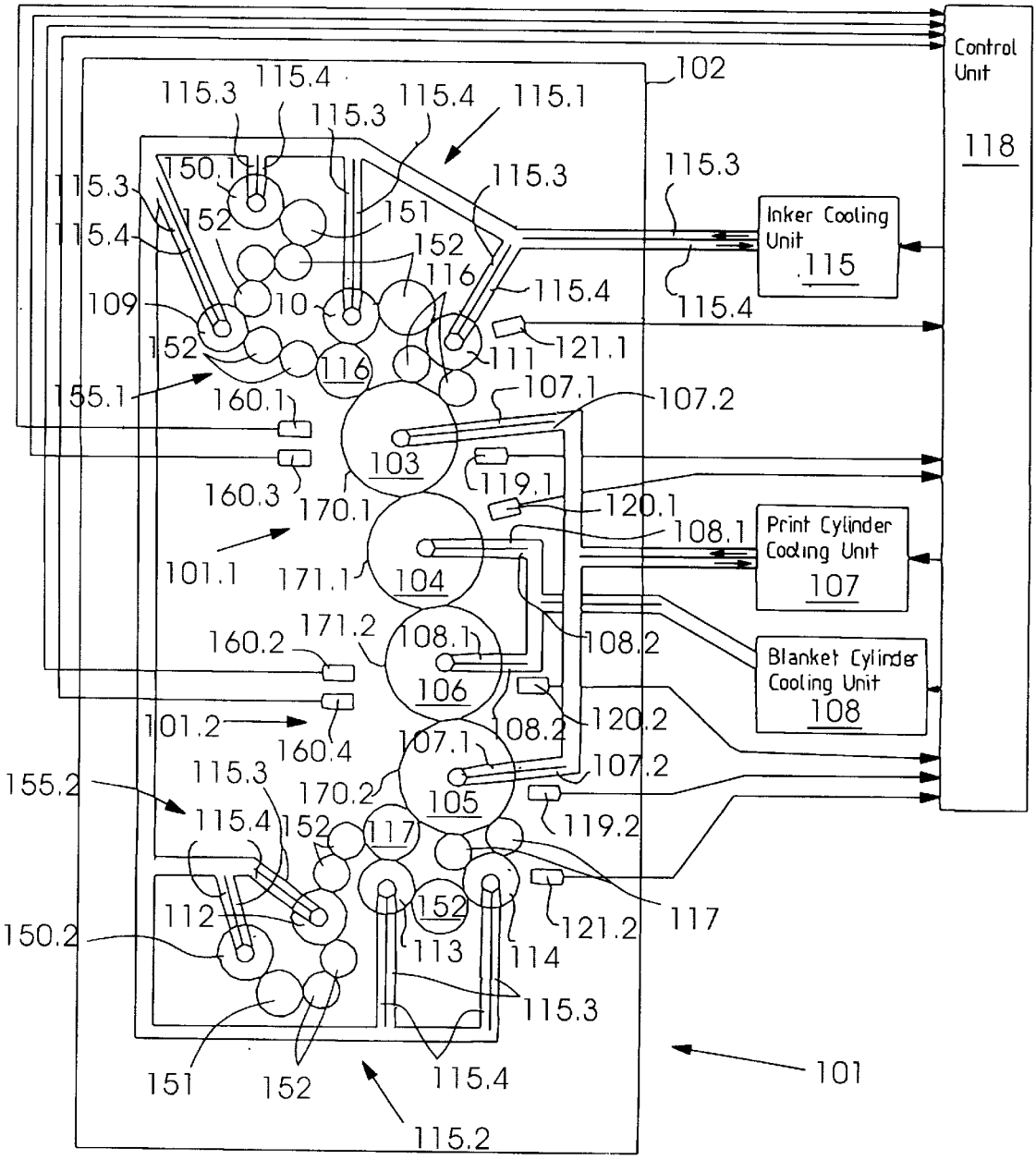
FIG. 6 shows a printing unit in accordance with a second embodiment of the present invention.

FIG. 6 shows a printing unit 101 in accordance with the present invention. The printing unit 101 includes side walls 102 supporting upper and lower inking units 155.1, 155.2, blanket cylinders 104, 106 and print cylinders 103, 105. The upper inking unit 155.1 includes a fountain roller 150.1 and metering roller 151 which apply an ink film to distributor rollers 152, and to vibrator rollers 109, 110 and 111 for splitting the ink film and providing an even ink profile over the width of the printing unit. The vibrator rollers 110, 111 distribute the ink film to a group of upper form rollers 116. The upper form rollers 116, in turn, apply the ink film to a print form 170.1 mounted on the upper print cylinder 103. Similarly, the vibrator rollers 113, 114 distribute the ink film to a group of lower form rollers 117, and the lower form rollers 117 apply the ink film to a print form 170.2 mounted on the lower print cylinder 105.

The print form 170 may be constructed as a flat plate mounted by its respective ends to the print cylinder, as a sleeve-shaped print form mounted axially over the print cylinder, or in any other known manner. In any case, the print form 170 is suitable for receiving and transferring an image using water based inks, as described above with regard to the embodiment of FIG. 1.

The printing unit 101 is designed to maintain acceptable printing conditions for printing with water based inks through the use of one or more cooling units. Referring to FIG. 6, a print cylinder cooling unit 107 is assigned to the upper and lower print cylinders 103, 105. The print cylinder cooling unit 107 includes a print cylinder inlet pipe 107.1 and a print cylinder outlet pipe 107.2 for each of the print cylinders 103, 105. A lower print cylinder sensor 119.2 is arranged near the lower print cylinder 105, and an upper print cylinder sensor 119.1 is arranged near the upper print cylinder 103. A pair of relative humidity sensors 160.1, 160.2 are mounted within the printing unit 101 to measure the relative humidity of the atmosphere in the upper print unit section 101.1 and lower printing unit section 101.2, and a pair of temperature sensors 160.3, 160.4 are mounted within the printing unit 101 to measure the temperature of the atmosphere in the upper print unit section 101.1 and lower printing unit section 101.2. A control unit 118 has respective inputs connected to the print cylinder sensors 119.1, 119.2, the relative humidity and temperature sensors 160.1, 160.2, 160.3, 160.4 and an output connected to the cooling unit 107. The control unit 118 periodically monitors the temperature of the print cylinders 103, 105 via the sensors 119.1, 119.2, and of the atmosphere with the relative humidity sensors 160.1, 160.2 and temperature sensors 160.3, 160.4, and then controls the print cylinder cooling unit 107 as a function of the monitored temperature values.

The print cylinder sensors 119.1, 119.2 can be constructed, for example, as infrared sensors mounted adjacent to the print cylinders 103, 105 to monitor the surface temperature of the print cylinders. The cooling unit 107 continuously circulates a cooling agent (e.g. water or air) through the print cylinders 103, 105 via the print cylinder inlet and outlet pipes 107.1, 107.2. By controlling the temperature of the cooling agent via the controlling device 118, the temperature of the cylinders 103, 105 can be maintained at a predetermined level (e.g., at a setpoint or within a predetermined range). The predetermined level is preferably set slightly above the dew point of the atmosphere surrounding the ink carrying surfaces of the print cylinders in order to prevent condensation of water from the atmosphere onto the ink carrying surfaces, and to minimize evaporation of water from the water-based inks into the atmosphere.

The predetermined level can be set as follows based upon the sensor readings. Relative humidity (RH) is a function of the amount of water per volume of air which is actually present in the atmosphere (VA) and the amount of water per volume of air which is necessary to saturate the air (VS): $VA/VS \times 100 = RH$. VS, in turn, is a function of the temperature of the atmosphere: $VS = f(t)$. Since the temperature of the atmosphere is known from sensors 160.3, 160.4, and the relative humidity of the atmosphere is known from sensors 160.1, and 160.2, VA and VS for the temperature of the atmosphere surrounding the ink carrying surfaces are readily determined by the control unit 118. Therefore, in order to maintain the temperature of the ink carrying surfaces above the dew point, the control unit can assume VA to remain constant, and choose a predetermined temperature level for the cylinders 103, 105 which has a corresponding VS which is slightly greater than VA.

Figure 8:
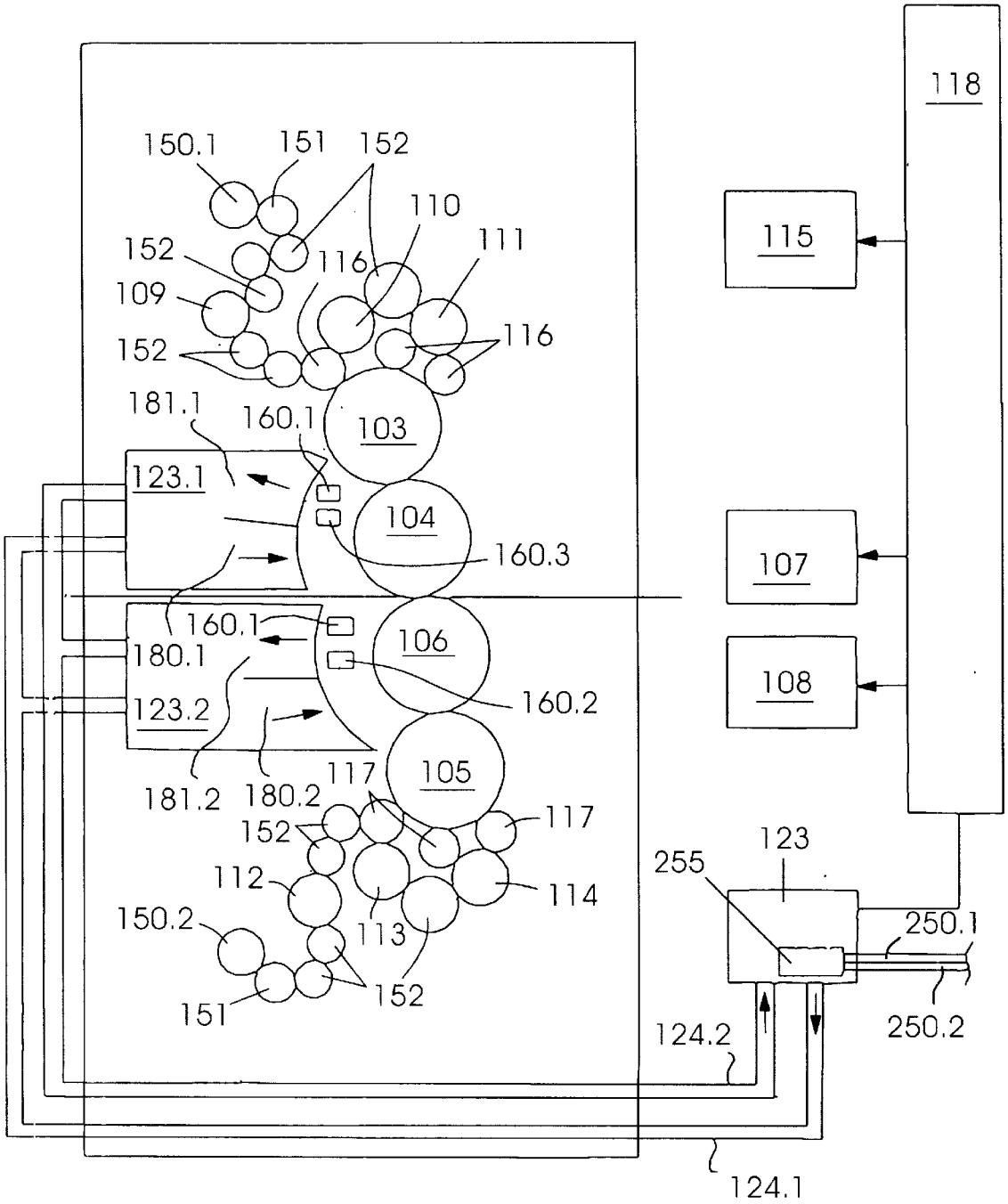
FIG. 8 shows a further embodiment of the printing unit of FIG. 6.

The upper and lower blanket cylinders 104, 106 have printing blankets 171.1, 171.2 mounted thereon for transferring an inked image from the print forms 170.1, 170.2 to a web of material 122 as shown in FIG. 8. The printing blanket 171 may be constructed as a flat blanket mounted by its respective ends to the blanket cylinder, as a gapless tubular printing blanket mounted axially over the blanket cylinder, or in any other known manner.

A blanket cylinder cooling unit 108 is assigned to the upper and lower blanket cylinders 104, 106. The blanket cylinder cooling unit 108 includes a blanket cylinder inlet 108.1 and a blanket cylinder outlet 108.2 for each blanket cylinder. A lower blanket cylinder sensor 120.2 is arranged near the lower blanket cylinder 106, and an upper blanket cylinder sensor 120.1 is arranged near the upper blanket cylinder 104. The control unit 118 has respective inputs connected to the blanket cylinder sensors 120.1, 120.2 and an output connected to the cooling unit 108. The control unit 118 periodically monitors the temperature of the blanket cylinders 104, 106 via the sensors 120.1, 120.2, and then controls the blanket cylinder cooling unit 108 as a function of the monitored temperature values as described above with regard to the print cylinders. The sensors 120 and cooling unit 108 can be constructed and controlled in the same manner as the sensors 119 and cooling unit 107.

An inker cooling unit 115 is assigned to the upper vibrator rollers 109, 110, 111, the lower vibrator rollers 112, 113 and 114, and the upper and lower fountain rollers 150.1, 150.2 respectively. The cooling unit 115 includes an upper section 115.1 assigned to the upper inker 155.1 and a lower section 115.2 assigned to the lower inker 155.2. An inker inlet pipe 115.3 and outlet pipe 115.4 is connected to each roller 109–114, 150.1, 150.2. A respective inker sensor 121.1, 121.2 is assigned to each inking unit 155.1, 155.2. In the configuration of FIG. 6, sensor 121.1 senses the temperature at an outer ink carrying surface of roller 111, and sensor 121.2 senses the temperature at an outer ink carrying surface of roller 114. The control unit 118 has respective inputs connected to the inker sensors 121.1, 121.2 and an output connected to the inker cooling unit 115. The control unit 118 periodically monitors the temperature of the vibrator rollers 111, 114 via the sensors 120.1, 120.2, and then controls the inker cooling unit 115 as a function of the monitored temperature values as described above with regard to the print cylinders. The sensors 121 and cooling unit 115 can be constructed and controlled in the same manner as the sensors 119 and cooling unit 107.

Figure 7A:
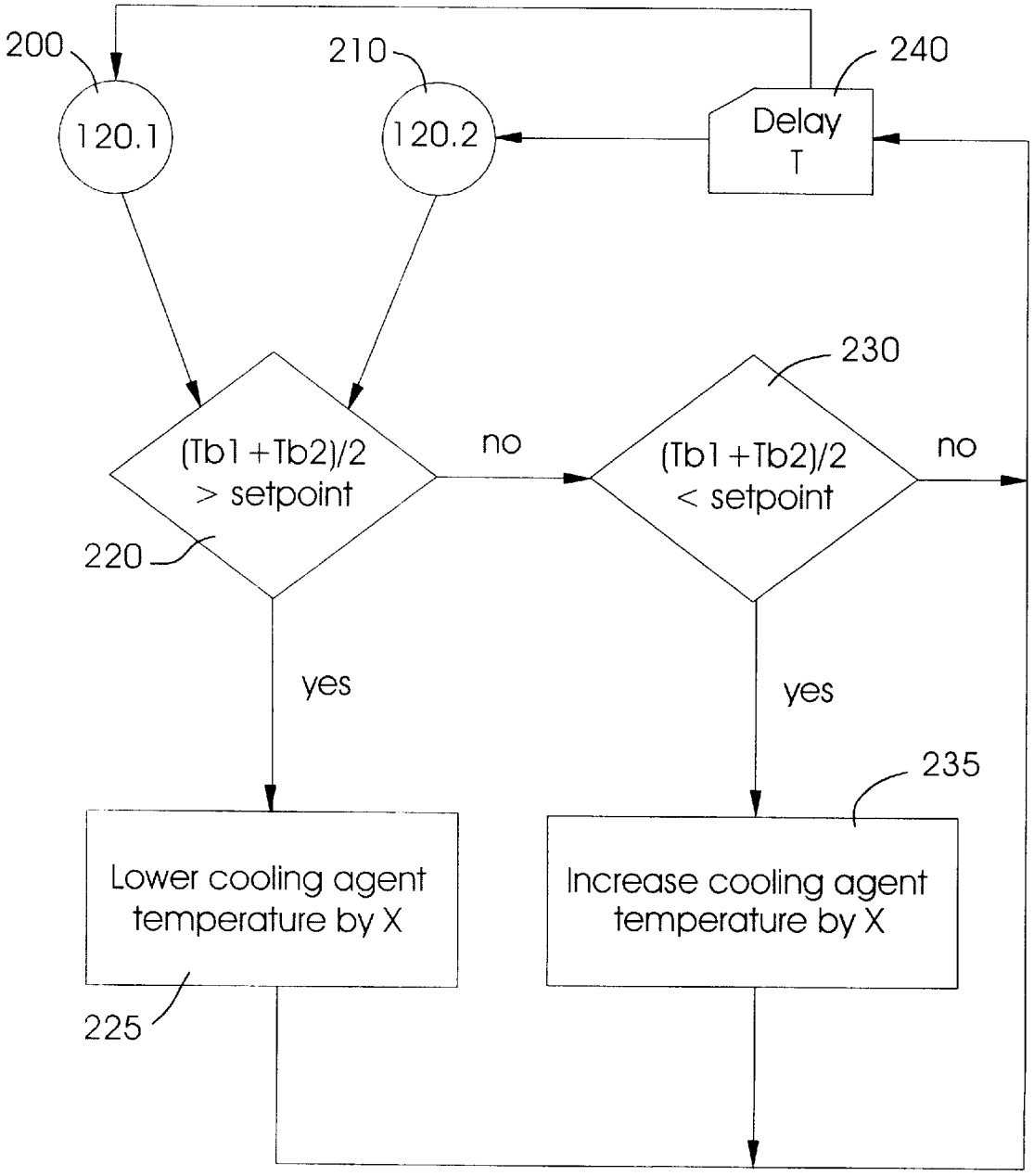
FIG. 7(*a–c*) show illustrative flow charts for the control unit of FIG. 6.
Figure 7B:
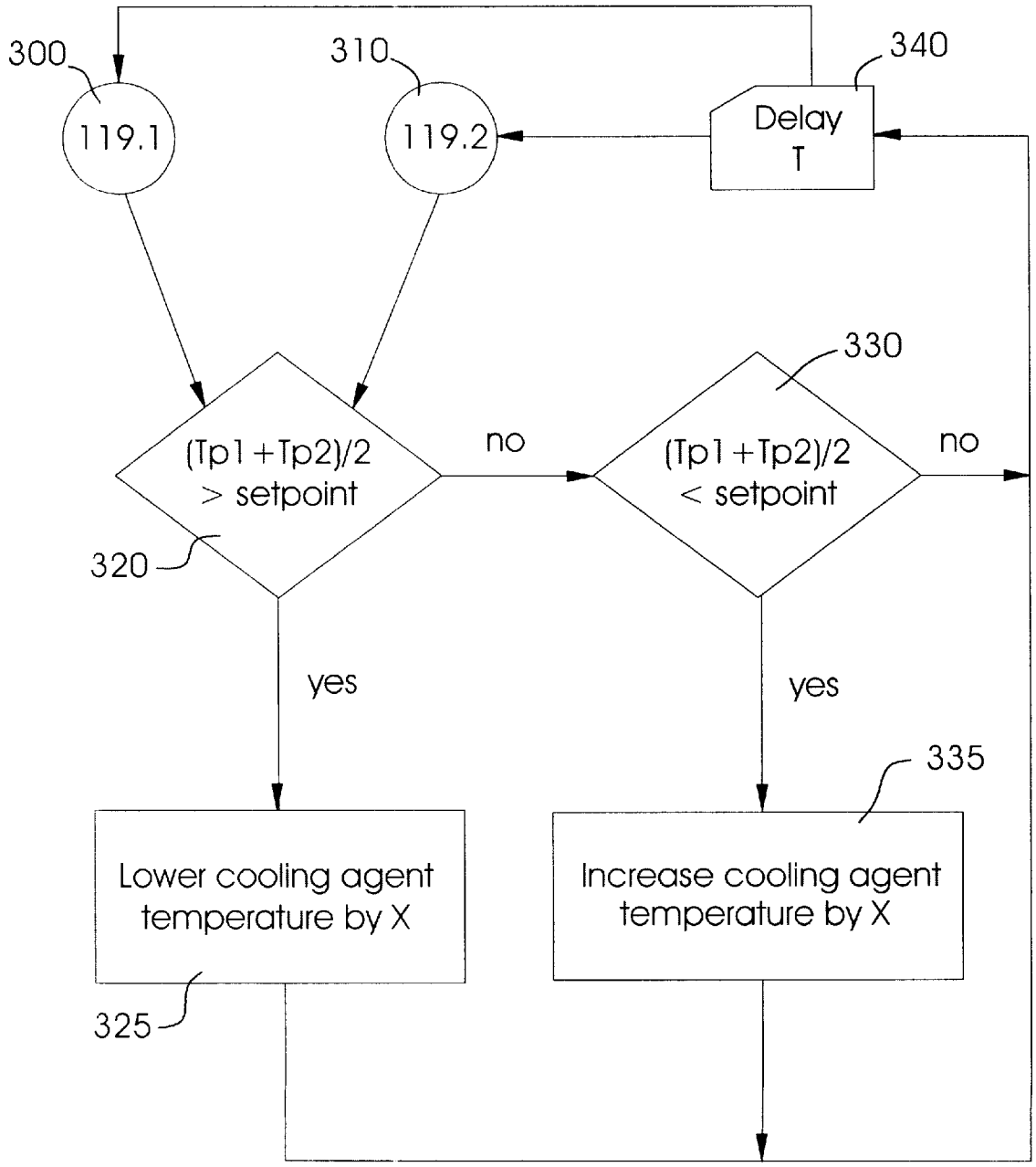
Figure 7C:
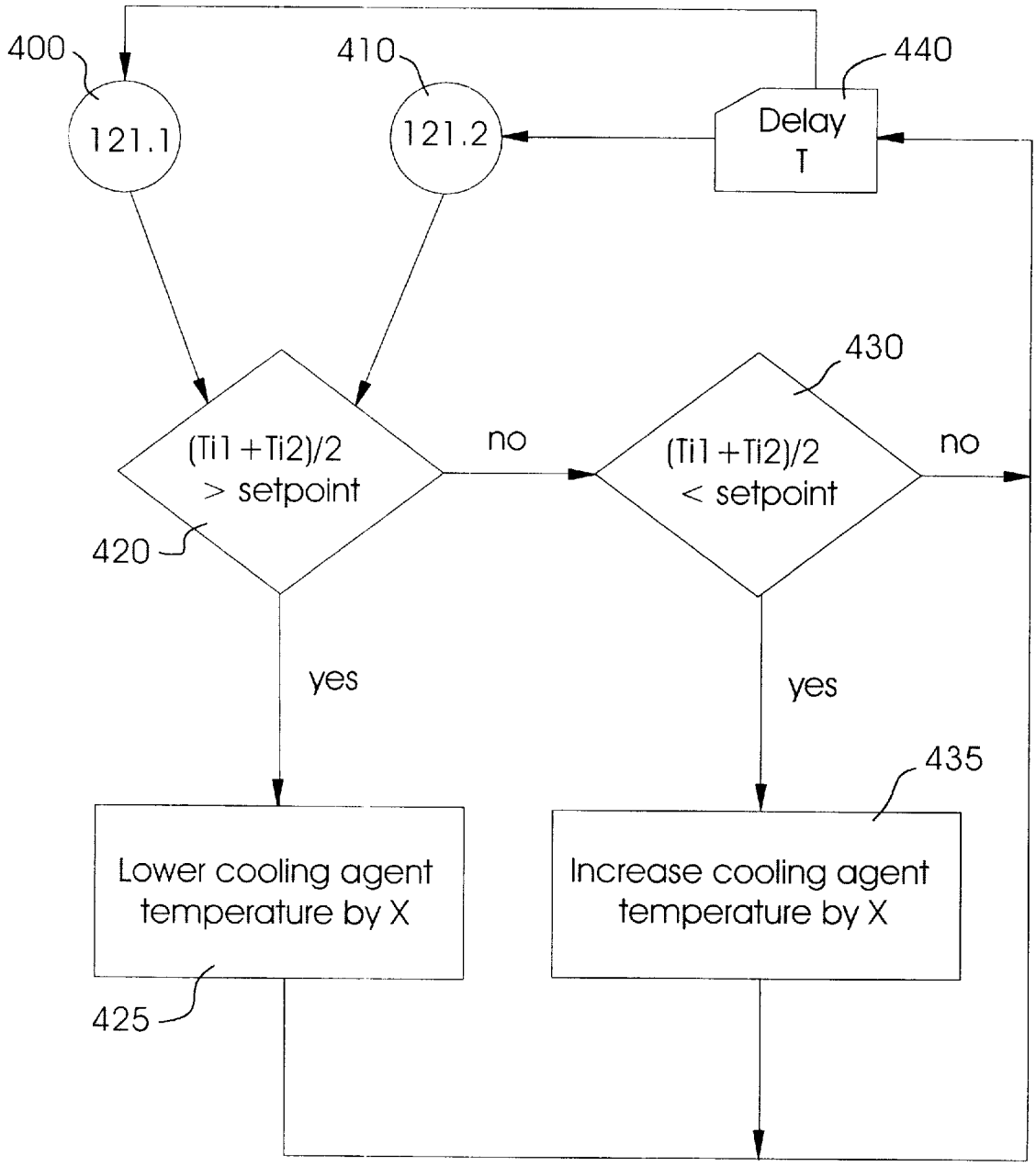

FIGS. 7(*a–c*) show an illustrative flow chart for the control unit 118. Referring to FIG. 7*a*, the control unit monitors the surface temperature of the upper blanket ($Tb_1$) and of the lower blanket ($Tb_2$) via the sensors 120.1, 120.2 (steps 200, 210). If an average of these sensor readings is above a set point (step 220), then the control unit 118 lowers the temperature of the cooling agent in the blanket cooling unit 108 by an amount X (step 225), waits a time period T (step 230), and then monitors the outputs of the sensors 120.1, 120.2 again. These steps are repeated until the average of the sensor readings is equal to the set point. Similarly, if the average of these sensor readings is below the set point (step 230), then the control unit 118 raises the temperature of the cooling agent in the blanket cooling unit 108 by an amount X (step 235), waits a time period T (step 245), monitors the outputs of the sensors 120.1, 120.2 again, and repeats these steps until the average of the sensor readings is equal to the set point As illustrated in FIGS. 7*b* and 7*c*, the control unit monitors and controls the temperature of the print cylinders 103, 105 (steps 300, 310, 320, 330, 325, 335, 340) and inker rollers 109–114, 150.1, 150.2 (steps 400, 410, 420, 430, 425, 435, 440) in the same manner. Preferably, the setpoint is set slightly above the dew point of the atmosphere surrounding the print cylinders, blanket cylinders, and inking unit. In this manner, the relative humidity of the atmosphere surrounding the ink carrying surfaces of the inking unit, blanket cylinders, and print cylinders will be high enough to prevent any significant evaporation of water from the ink, but low enough to prevent condensation of water from the atmosphere onto the ink carrying surfaces. The set point can be obtained based upon the monitored values of the sensors 160.1 through 160.4 as described above.

It should be noted that since the temperature of the cylinders and rollers in the printing unit 101 tend to rise naturally due to the heat generated from the operation of the press, it is possible to eliminate steps 330 and 335 in the flow charts of FIGS. 7*a* through 7*c*, and to rely instead on the natural tendency of the temperature of the cylinders and rollers to rise over time. In such an embodiment, the cooling units 107, 108, and 115 need not include a device for heating the cooling agent. Moreover, the above referenced flow charts are merely illustrative, and could be replaced with any suitable algorithm known in the art for matching a measured value to a desired value.

In the embodiment shown in FIGS. 6 and 7*a–c*, separate sensors 1 19.1, 119.2 are provided for the upper and lower print cylinders 103, 105, and the temperature of the cooling agent applied to both cylinders is a function of the average of the two sensor readings. However, it is also possible to control the temperature of the cooling agent as a function of the temperature measured at only one of the cylinders (103 or 105) by one sensor (119.1 or 119.2). Similarly, a single temperature sensor (160.3 or 160.4) and humidity sensor (160.1 or 160.2) could be used. In such an embodiment, the temperature of the cooling agent circulated within both print cylinders will be a function of the temperature measured at the ink carrying surface of only one of the cylinders (103 or 105). The sensor pairs 120.1, 120.2 and 121.1, 121.2 could likewise be replaced with single sensors measuring the temperature at one of the blanket cylinders (104 or 106) and at one of the inking units (155.1 or 155.2).

Moreover, it is also possible to provide separate cooling units for some or all of the cylinders 103,104,105, 106 and rollers 109, 110, 111, 112, 113, 114, 150.1, 150.2 and to control the temperature of the cooling agent applied to these cylinders and rollers individually via the control unit as a function of separate sensors.

In order to provide acceptable conditions for printing with water based inks, the temperature of the ink and of the surfaces the ink is applied to should be maintained at certain predetermined levels. For example, in a water based ink containing 2% ethanol amine or ammonia, if the temperature of the print cylinders is maintained between 93–95 degrees, and 75–95% humidity, high print quality can be maintained. Naturally, these levels are merely illustrative, and may vary in accordance with a number of factors including the particular construction of the printing unit, the particular composition of the water based ink, and the paper being used. In accordance with the present invention, the temperature of the cylinders 103–106 and rollers 109–114 are monitored by the control unit, and is maintained within the desired temperature range (or at a desired set point) by selectively controlling the temperature of the cooling agent flowing through these cylinders and rollers. This control may be similar to the control described above with reference to the embodiment of FIG. 1.

For example, when a printing press is first started, the printing unit components 103–106, 109–114, 150.1, 150.2 will be relatively cold. Therefore, the control unit 118, by monitoring the temperature sensors 119–121, will determine that the temperature on the ink carrying surfaces of the blanket cylinders 104, 106, print cylinders 103, 105, and vibrator rollers 111, 114 is below the desired temperature level for the water based ink and paper being used. The control unit 118 will then advise the press operator to pre-heat the printing unit 101 prior to printing. Such a preheating could be accomplished by running the press while off impression until the temperature of the blanket cylinders 104, 106, print cylinders 103, 105, and vibrator rollers 111, 114 has reached the desired level. Alternatively, the control unit 118 could raise the temperature of the cooling agent in the blanket cylinder cooling unit 108, the print cylinder cooling unit 107, and the inker cooling unit 115 until the temperature of the blanket cylinders 104, 106, print cylinders 103, 105, and vibrator rollers 111, 114 has reached the desired level.

In contrast, after the printing press has been printing for a period of time, the temperature on the ink carrying surfaces of one or more of the blankets, print forms or rollers (170, 171, 109–114, 150.1, 150.2) within the printing unit 101 may rise above the desired temperature level. The control unit 118, by monitoring the temperature sensors 119–121, will detect that the temperature on the ink carrying surfaces of the blankets, print forms, and/or vibrator rollers (171.1, 171.2, 170.1, 170.2, 111, and/or 114) is above the desired temperature level for the water based ink and paper being used, and will then lower the temperature of the cooling agent in the respective cooling units (107, 108, and/or 115) as necessary until the temperature of the blankets, print forms, and/or vibrator rollers has reached the desired level.

FIG. 8 shows a further embodiment of the printing unit of FIG. 6. The pipes 107.1, 107.2, 108.1, 108.2, 115.3, 115.4 and sensors 119–121 have been omitted for ease of illustration. In accordance with this embodiment, blowing sections 123.1, 123.2 are mounted within the printing unit 101, and connected to a blowing unit 123 via an air inlet pipe 124.1 and an air exhaust pipe 124.2. The blowing unit 123 includes an air cooling mechanism and an air heating mechanism, and is coupled to and controlled by the control unit 118 to maintain the temperature of the water based ink carrying surfaces of the blanket cylinders 104, 106 at the set point. The blowing devices 123.1 and 123.2 each include outputs 180 to blow air onto the surfaces of the blanket cylinder 104, 106 carrying the water based ink films. The blowing devices 123.1 and 123.2 also include suction inputs 181 for sucking the atmosphere surrounding the water based ink carrying surfaces out through the air exhaust pipe 124.2. In this manner, the water based ink carrying surfaces of the blanket are cooled or heated from the outside via the blowing unit 123, and from the inside via the cooling units 108.

Figure 8A:
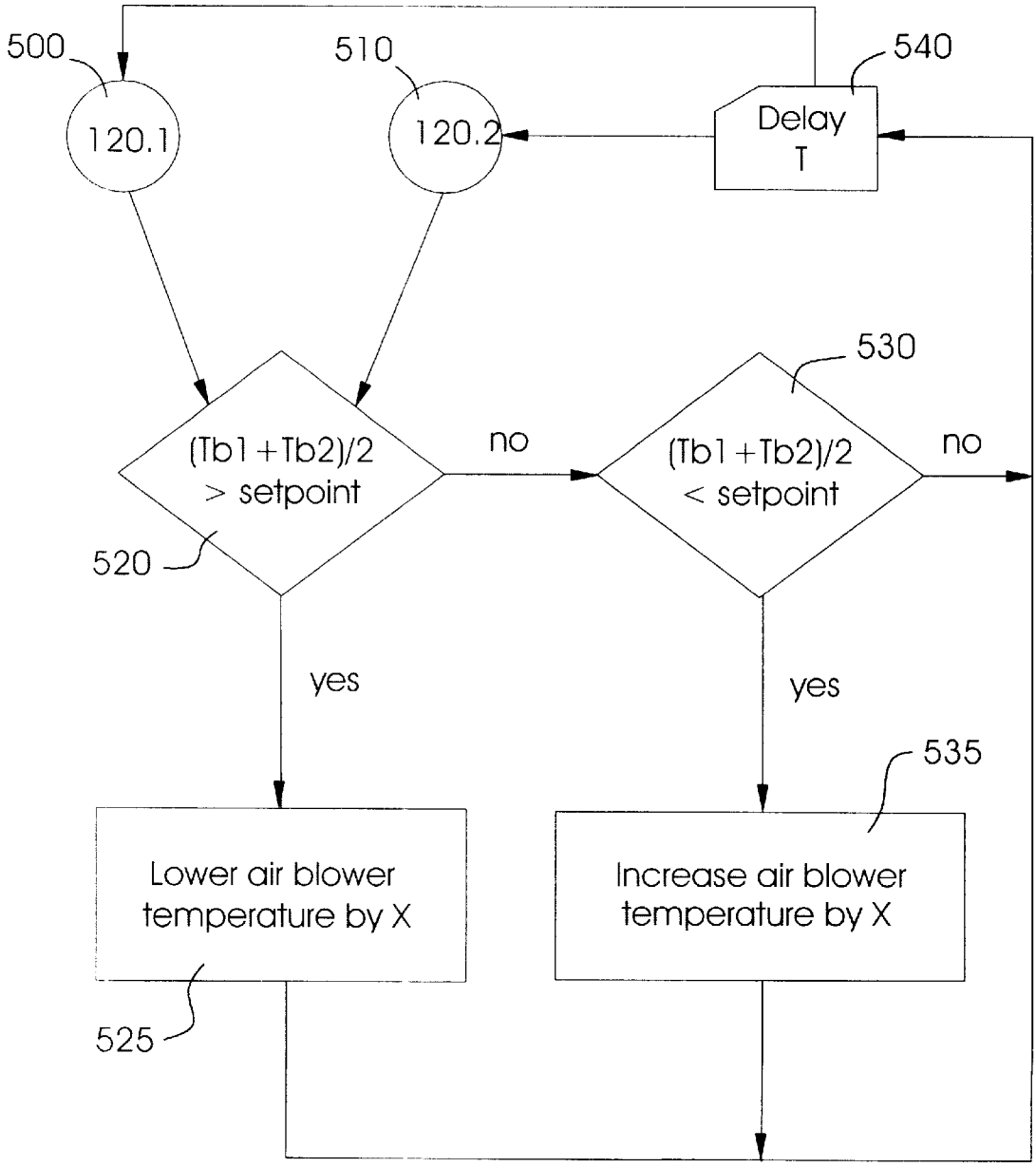

Referring to FIG. 8*a*, the control unit 118 monitors the surface temperature of the upper blanket cylinder ($Tb_1$) and of the lower blanket cylinder ($Tb_2$) via the sensors 120.1, 120.2 (steps 500, 510). If an average of these sensor readings is above the set point (step 520), then the control unit 118 lowers the temperature of the air output from the air inlet 124.1 by an amount X (step 525), waits a time period T (step 540), and then monitors the outputs of the sensors 120.1, 120.2 again. These steps are repeated until the average of the sensor readings is equal to the set point. Similarly, if the average of these sensor readings is below the set point (step 530), then the control unit 118 raises the temperature of the air output from the air inlet 124.1 by an amount X (step 535), waits a time period T (step 540), monitors the outputs of the sensors 120.1, 120.2 again, and repeats these steps until the average of the sensor readings is equal to the set point The heating and/or cooling of the air by the blowing device 123 can be accomplished inside or outside the blowing devices 123.1, 123.2. Moreover, in accordance with a further embodiment of the present invention, the blowing devices 123.1, 123.2 could be arranged within the printing unit 101 to blow air on both the print cylinders 103, 105 and the blanket cylinders 104, 106.

As discussed above with regard to FIGS. 7(*a–c*), since the temperature of the cylinders and rollers in the printing unit 101 tends to rise naturally due to the heat generated from the operation of the press, it is possible to eliminate steps 530 and 535 in the flow charts of FIG. 8*a*, and to rely instead on the natural tendency of the temperature of the cylinders and rollers to rise over time. In such an embodiment, the air heating mechanism can be omitted from the blowing device 123. In addition, the above referenced flow chart is merely illustrative, and could be replaced with any suitable algorithm known in the art for matching a measured value to a desired value.

In accordance with another embodiment of the present invention, the blowing unit 123 includes a humidifier 255 which is controlled by the control unit 118 and supplied by water supply lines 250.1, 250.2. The humidifier 255 may be arranged within the blowing unit 123, within the blowing devices 123.1, 123.2, in between the blowing unit 123 and blowing devices 123.1, 123.2, or in any other suitable location. If the control unit 118 determines that the monitored relative humidity is below a humidity set point, it will activate the humidifier until the monitored humidity is equal to the humidity set point. By maintaining the humidity of the atmosphere surrounding the ink carrying surfaces at the humidity setpoint (e.g. between 75% and 95% relative humidity), evaporation of water from the water-based ink can be minimized while still preventing condensation of water into the ink. Moreover, by controlling the humidity within the atmosphere surrounding the print and/or blanket cylinders, the temperature set point can be set at a static value (e.g., 93–95 degrees Fahrenheit).

FIG. 9 shows a temperature controlling device in accordance with the present invention for maintaining an even temperature profile across the printing unit 101. The sidewalls 102 include a gear-side wall 102.1 and a work-side wall 102.2. During press operation, the gear-side wall 102.1, which houses the gears which drive the cylinders and/or rollers in the printing unit 101, tends to become significantly hotter than the work-side wall 102.2. Consequently, it is advantageous to cool the gear-side wall 102.1 to provide an even temperature profile over the width of said printing unit 101.

In accordance with the present invention, a gear-side temperature sensor 126 is mounted on the gear-side wall 102.1 and a work-side temperature sensor 128 is mounted on the work-side wall 102.2. Each of the temperature sensors 126, 128 is connected to the control unit 118. A friction reducing fluid such as mineral oil or synthetic oil is conventionally provided within a gear box 132 of the gear-side wall 102.1 to lubricate the moving parts within the gear-side wall 102.1. A fluid distribution 182 is provided for circulating the friction reducing fluid to and from a heat exchanger 129. The heat exchanger 129 may be of conventional construction, and operates to cool the fluid in the fluid distribution 182 by, for example, inter-twining the fluid distribution 182 with a fluid pipe 162 containing a cooling fluid such as water. The control unit 118 monitors the temperature of the work-side and gear-side walls 102.2, 102.1 via the sensors and controls a fluid cooling unit 161 as a function of the monitored temperatures. The control unit 118, via the fluid cooling unit 161, adjusts the temperature of the cooling fluid within the fluid pipe 162 in order to maintain a temperature differential between the values measured at sensors 126 and 128 within a certain setpoint range (e.g. $|T_{26}-T_{28}| \leqq 7$ degrees Fahrenheit).

In the above embodiment, it is anticipated that the design of the work-side frame components is such that the temperature of the work-side frame at 127 does remains within approximately 10 degrees Fahrenheit of the ambient temperature of the surrounding atmosphere. If, however, the work-side frame exceeds the ambient temperature by more than 10 degrees Fahrenheit, it may be necessary to provide a work-side cooling mechanism for the work side frame 102.2. Referring to FIG. 9(*a*), the cooling mechanism, could, for example, include a cooling unit 199 which circulates a cooling agent through pipes 198 which are mounted to the work-side frame 102.2. The cooling unit 199 could monitor the ambient temperature of the air surrounding the work-side frame 102.2 via a temperature sensor 127, monitor the temperature of the work-side frame 102.2 via the sensor 128, and lower the temperature of the cooling agent if the difference between the monitored values exceed 10 degrees Fahrenheit.

Figure 10:
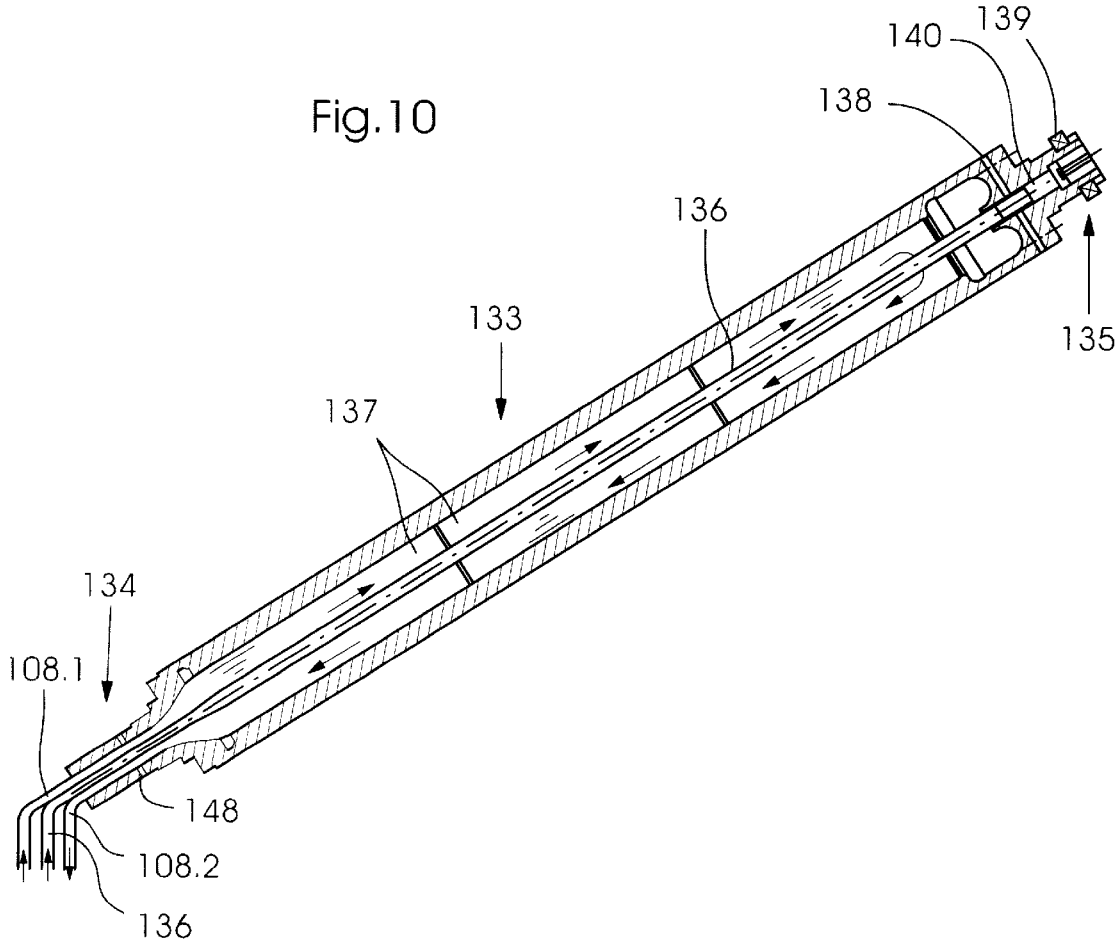
FIG. 10 shows the blanket cylinder of FIG. 6 in more detail.

FIG. 10 shows a longitudinal section of one of the blanket cylinders 104, 106. The blanket cylinder 104, 106 includes the blanket cylinder inlet 108.1 and a blanket cylinder outlet 108.2 for circulating the cooling agent through the blanket cylinder. In addition, the blanket cylinder includes a compressed air inlet 136 which transmits compressed air across the length of the cylinder and out a plurality of apertures 138 along the surface of the blanket cylinder in order to axially install and remove a printing blanket. In accordance with a preferred embodiment of the present invention, the air inlet 136 is isolated from the cooling agent circulating within the cylinder in the manner described in U.S. Pat. No. 5,535,674, issued Jul. 16, 1996, the specification of which is hereby incorporated by reference. The cooling agent can be circulated through the print cylinder 103, 105, and rollers 109–114 in a similar manner.

Figure 11:
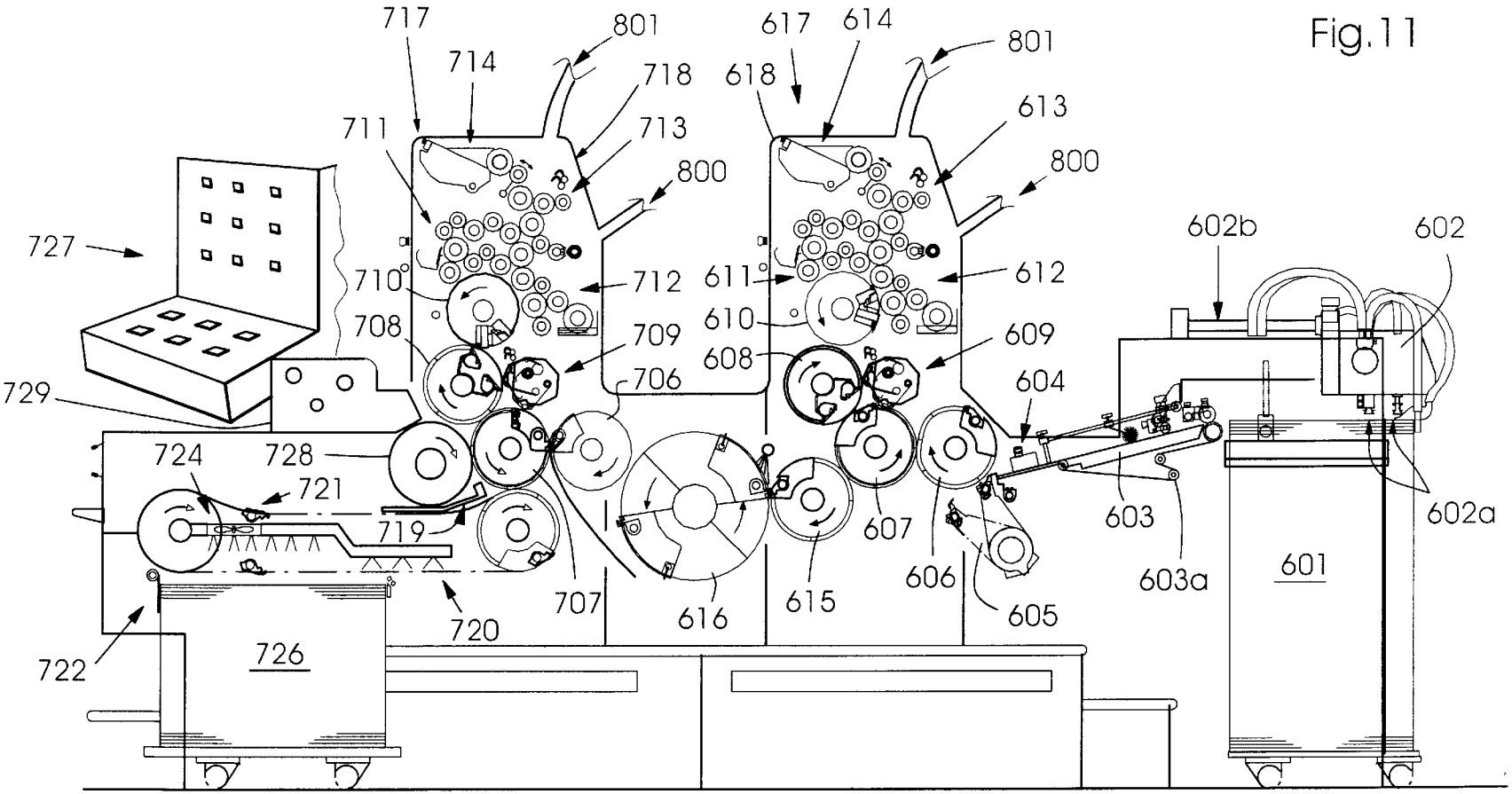
FIG. 11 shows a third, sheet-fed, embodiment of the present invention.

FIG. 11 shows an embodiment of the present invention in a sheet-fed printing unit. From a stacked sheet feed pile 601, sheets are delivered to a feed table 603. The feed pile may be mounted on a feed table which moves upwardly to ensure that the top sheet of the feed pile 601 is adjacent a gripping head 602. The gripping head 602, including suction grippers 602*a*, reciprocates back and forth under the action of a suitable actuator 602*b*. The suction grippers 602*a* separate a top sheet from the feed pile 601 and feeds it onto the feed table 603, either separately or in shingled form. The feed table 603 is preferably in the form of a conveying belt 603*a*. An aligning device 604 at the end of feed table 603 aligns the sheets in preparation for receipt by a pregripper 605. The pregripper 605 includes a gripper at one end, which grasps an end of an aligned sheet, and accelerates and feeds that sheet into a gripping drum 606 in a first printing unit 617. Gripper drum 606 includes a gripper which grips a sheet fed from pregripper 605 and rotates that sheet and feeds it to an impression cylinder 607. The impression cylinder 607 feeds a sheet against a blanket cylinder 608, which blanket cylinder 608 prints an image upon the sheet carried upon the impression cylinder 607. The blanket cylinder may carry either a conventional gapped blanket or a gapless blanket. The surfaces of the impression cylinder 607 and the blanket cylinder 608 may be cleaned by a pivotable washing device 609. Mounted above the blanket cylinder 608 is a plate cylinder 610 carrying a conventional print form or print plate, and which transfers an image to blanket cylinder 608. The plate cylinder may be inked by a conventional inking form rollers 611 and wetted or dampened by conventional damping cylinders 612. An inker 613 transfers printing ink from an ink fountain 614 to the form rollers 611.

After the sheet on impression cylinder 607 has been printed upon by blanket cylinder 608, a second gripper drum 615 grips the sheet and transfers it to a conventional perfecting device 616 which transfers the sheet to its opposite side. The sheet, having been reversed to its other side by perfecting device 616 is then transferred to a third gripper drum 706 in a second printing unit 717. The second printing unit 717 has similar structure to that of the first printing unit 617, including gripper drum 706, an impression cylinder 707, blanket cylinder 708, plate cylinder 710, form rollers 711, damping cylinders 712, inker 713 and ink fountain 717. Each of these elements operate in the same manner as the similar elements in first printing unit 617. After a sheet has had both sides printed upon by first and second printing units 617, 717, the sheet is fed to a delivery stack 726 by a transport chain 720 in a delivery device 722, which grips the sheets and delivers them to a position above delivery stack 726. A guiding device 719 may guide sheets to the transport chain 720, and an optional numbering cylinder 728 may be used to imprint numbering information on sheets leaving the impression cylinder 707. Transport chain 720 includes a series of gripper elements 721 for gripping and transporting sheets to the delivery stack 726. The numbering cylinder 728 may be colored by a removably mountable color head 729. A series of blowers 724 may be mounted above transport chain 720 to blow sheets onto the delivery stack 726. An operating console 727 may be used to input information to control the overall printing process.

Hoods or housings 618, 718 preferably cover the first and second printing units 617, 717, respectively. Alternatively, a single hood could cover both printing units 617, 717, or multiple hoods (like those shown in the embodiment of FIG. 5) could be used with each printing unit 617, 717. As shown in FIG. 11, inlets 800 and outlets 801 can be used to provide heated or cooled air, humidity, and/or chemicals in the manner described above with reference to the embodiments of FIGS. 1–11. It is to be understood that although FIG. 11 shows a single inlet 800 and a single outlet 801, multiple inlets and outlets could be provided in the manner, e.g., shown in FIGS. 5, 6, 8. Additionally, the hoods 618 or 718 can include insulation and heating in the manner shown in, e.g., FIGS. 1, 4, 5 or 8, and cylinders 608, 610, 708, 710, inking form rollers 611, 711, damping cylinders 612, 712 and inkers 613, 713 can include cooling of the type shown in FIG. 6.

Figure 12:
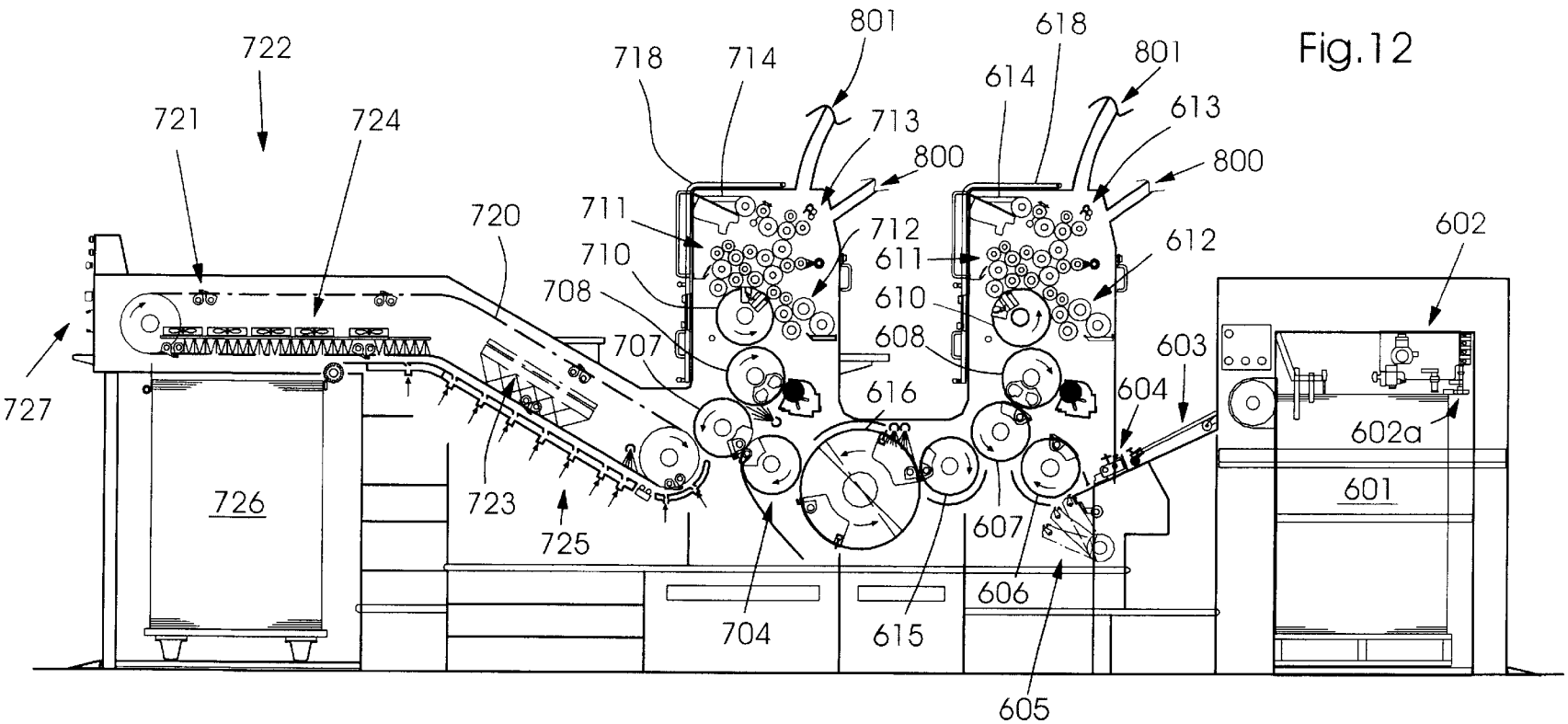
FIG. 12 shows a fourth, sheet-fed, embodiment of the present invention.

FIG. 12 shows an alternative embodiment to the embodiment of FIG. 11. Like elements to those in FIG. 11 are labeled with like reference numerals in FIG. 12. In the embodiment of FIG. 12, a longer transport chain 720 is used, which has a larger number of gripper elements 721. A series of infrared or ultraviolet drying elements 723 may be used to dry sheets transported on transport chain 720. In the area between the impression cylinder 707 and the delivery stack 726 can be a series of air cushion devices 725 which deliver pressurized air. The pressurized air cushion created by air cushion devices 725 can transport sheets, without physical contact with the sheets, to the delivery stack 726. This contactless transport prevents smearing of the printed image. In all other respects, the embodiment of FIG. 12 is similar to the embodiment of FIG. 11 described above.

It is to be understood that the above description is of preferred embodiments, and that other embodiments are contemplated to fall within the scope of the invention. It will be understood by those skilled in the art that other embodiments or configurations fall within the scope of the claims below.

What is claimed is:

1. A printing unit for a rotary printing press, comprising:

a print cylinder;

an inking mechanism for applying an ink to the print cylinder, the ink including an amine;

a housing at least partially surrounding at least one of the inking mechanism and the print cylinder, an at least semi-enclosed space being formed between the housing and at least one of the inking mechanism and the print cylinder; and a humidifier for controlling the humidity of the atmosphere within the at least semi-enclosed space.

2. The printing unit of claim 1, further comprising:

a humidity sensor mounted within the at least semi-enclosed space.

3. The printing unit according to claim 1 wherein the amine is an ethanol amine.

4. The printing unit according to claim 1, further comprising a blanket cylinder in rotational contact with the printing cylinder.

5. A printing unit for a sheet-fed rotary printing press, comprising:

a print cylinder;

an inking mechanism for applying an ink to the print cylinder, the ink including an amine;

a housing at least partially surrounding at least one of the inking mechanism and the print cylinder, an at least semi-enclosed space being formed between the housing and at least one of the inking mechanism and the print cylinder;

a humidifier for controlling the humidity of the atmosphere within the at least semi-enclosed space; and a gripping head, the gripping head feeding sheets to the print cylinder.

6. The printing unit of claim 5, further comprising:

a humidity sensor mounted within the at least semi-enclosed space.

7. The printing unit of claim 5, wherein:

the housing at least partially surrounds both the inking mechanism and the print cylinder.

8. The printing unit of claim 5, wherein:

the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

9. The printing unit according to claim 5, wherein the print cylinder comprises:

a first print cylinder, the first print cylinder printing on a first side of a sheet;

the inking mechanism comprises a first inking mechanism for applying ink to the first print cylinder; and further comprising:

a second print cylinder located downstream of the first print cylinder, the second print cylinder printing on a second side of the sheet; and an second inking mechanism for applying ink to the second print cylinder, the ink including an amine;

the housing at least partially surrounding the first and second inking mechanisms, a first and a second at least semi-enclosed space being formed between the housing and the first and second inking mechanisms, respectively.

10. The printing unit according to claim 5 wherein the amine is an ethanol amine.

11. The printing unit according to claim 9 wherein the amine is an ethanol amine.

12. The printing unit for a sheet-fed rotary printing press comprising:

a print cylinder;

an inking mechanism for applying an ink to the print cylinder, the ink including a substance;

a housing at least partially surrounding at least one of the inking mechanism and the print cylinder, an at least semi-enclosed space being formed between the housing and at least one of the inking mechanism and the print cylinder;

a humidifier for controlling the humidity of the atmosphere within the at least semi-enclosed space;

a gripping head, the gripping head feeding sheets to the print cylinder;

a cooling mechanism for cooling the atmosphere within the at least semi-enclosed area;

a chemical agent supply for adding a chemical agent to an atmosphere in the at least semi-enclosed space, the atmosphere with the chemical agent reducing a rate of evaporation of the substance from the ink; and a control unit coupled to the cooling mechanism, humidifier, and the chemical agent supply for selectively actuating the cooling mechanism to control the temperature, humidity, and amount of chemical agent in the atmosphere within the semi-enclosed area.

13. The printing unit according to claim 12, further comprising:

a temperature sensor mounted within the at least semi-enclosed space, and outputting a temperature signal to the control unit;

a humidity sensor mounted within the at least semi-enclosed space, and outputting a humidity signal to the control unit;

a chemical agent sensor mounted within the at least semi-enclosed space, and outputting a chemical agent level signal to the control unit; and wherein the control unit controls the cooling mechanism, the humidifier, and the chemical agent supply as a function of one or more of the temperature signal, the humidity signal, and the chemical agent signal.

14. The printing unit according to claim 12, wherein the housing includes a hollow interior, and wherein the cooling mechanism includes a cooling inlet connected to the hollow interior of the housing, and a cooling outlet connected to the hollow interior of the housing, the cooling mechanism including means for circulating a cooling agent into the cooling inlet, through the hollow interior of the housing, and out of the cooling outlet.

15. The printing unit according to claim 13, further including an air exhaust extending from the semi-enclosed space through to the exterior of the housing, the air exhaust being connected to the control unit, the control unit activating the air exhaust as a function of one or more of the temperature signal, the humidity signal, and the chemical agent signal.

16. The printing unit according to claim 12, further comprising a blanket cylinder in rotational contact with the printing cylinder.

17. A printing unit for a sheet-fed rotary printing press, comprising:

a print cylinder;

an inking mechanism for applying an ink to the print cylinder, the ink including an amine;

a housing at least partially surrounding at least one of the inking mechanism and the print cylinder, an at least semi-enclosed space being formed between the housing and at least one of the inking mechanism and print cylinder;

a chemical agent supply for adding a chemical agent to an atmosphere in the at least semi-enclosed space, the atmosphere with the chemical agent reducing a rate of evaporation of the substance from the ink; and a gripping head, the gripping head feeding sheets to the print cylinder.

18. The printing unit according to claim 17 wherein the amine is an ethanol amine.

19. A printing unit for a sheet-fed rotary printing press, comprising:

a first print cylinder for printing on a first side of a sheet;

a first inking mechanism for applying an ink to the first print cylinder, the ink including a substance;

a second print cylinder located downstream of the first print cylinder, for printing on a second side of the sheet;

a second inking mechanism for applying ink to the second print cylinder, the ink including a substance;

a housing at least partially surrounding the first and second inking mechanisms, a first and second at least semi-enclosed space being formed between the housing and the first and second inking mechanisms, respectively;

a chemical agent supply for adding a chemical agent to an atmosphere in the at least semi-enclosed space, the atmosphere with the chemical agent reducing a rate of evaporation of the substance from the ink; and a gripping head for feeding sheets to the print cylinder;

wherein the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

20. A printing unit for a sheet-fed rotary printing press, comprising:

a first print cylinder for printing on a first side of a sheet;

a first inking mechanism for applying an ink to the first print cylinder, the ink including a substance;

a second print cylinder located downstream of the first print cylinder, for printing on a second side of the sheet;

a second inking mechanism for applying ink to the second print cylinder, the ink including a substance;

a housing at least partially surrounding the first and second inking mechanisms, a first and second at least semi-enclosed space being formed between the housing and the first and second inking mechanisms, respectively;

a chemical agent supply for adding a chemical agent to an atmosphere in the at least semi-enclosed space, the atmosphere with the chemical agent reducing a rate of evaporation of the substance from the ink; and a gripping head for feeding sheets to the print cylinder;

wherein the substance in the water based ink is an organic amine compound.

21. A printing unit for a sheet-fed rotary printing press, comprising:

a first print cylinder for printing on a first side of a sheet;

a first inking mechanism for applying an ink to the first print cylinder, the ink including a substance;

a second print cylinder located downstream of the first print cylinder, for printing on a second side of the sheet;

a second inking mechanism for applying ink to the second print cylinder, the ink including a substance;

a housing at least partially surrounding the first and second inking mechanisms, a first and second at least semi-enclosed space being formed between the housing and the first and second inking mechanisms, respectively;

a chemical agent supply for adding a chemical agent to an atmosphere in the at least semi-enclosed space, the atmosphere with the chemical agent reducing a rate of evaporation of the substance from the ink; and a gripping head for feeding sheets to the print cylinder;

wherein the ink is a water-based ink and the substance in the water based ink is ammonia.

22. A printing unit for a sheet-fed rotary printing press, comprising:

a first print cylinder for printing on a first side of a sheet;

a first inking mechanism for applying an ink to the first print cylinder, the ink including a substance;

a second print cylinder located downstream of the first print cylinder, for printing on a second side of the sheet;

a second inking mechanism for applying ink to the second print cylinder, the ink including a substance;

a housing at least partially surrounding the first and second inking mechanisms, a first and second at least semi-enclosed space being formed between the housing and the first and second inking mechanisms, respectively;

a chemical agent supply for adding a chemical agent to an atmosphere in the at least semi-enclosed space, the atmosphere with the chemical agent reducing a rate of evaporation of the substance from the ink; and a gripping head for feeding sheets to the print cylinder;

wherein the ink is a water based ink and wherein the chemical agent is ammonia.

23. A printing unit for a sheet-fed rotary printing press, comprising:

a first print cylinder for printing on a first side of a sheet;

a first inking mechanism for applying an ink to the first print cylinder, the ink including a substance;

a second print cylinder located downstream of the first print cylinder, for printing on a second side of the sheet;

a second inking mechanism for applying ink to the second print cylinder, the ink including a substance;

a housing at least partially surrounding the first and second inking mechanisms, a first and second at least semi-enclosed space being formed between the housing and the first and second inking mechanisms, respectively;

a chemical agent supply for adding a chemical agent to an atmosphere in the at least semi-enclosed space, the atmosphere with the chemical agent reducing a rate of evaporation of the substance from the ink; and a gripping head for feeding sheets to the print cylinder;

wherein the ink is a water based ink and wherein the substance in the water based ink is a pH increasing chemical.

24. A printing unit for a sheet-fed rotary printing press comprising:

a first print cylinder printing on a first side of a sheet;

an inking mechanism for applying an ink to the print cylinder, the ink including a substance;

a housing at least partially surrounding at least one of the inking mechanism and the print cylinder, an at least semi-enclosed space being formed between the housing and at least one of the inking mechanism and print cylinder;

a chemical agent supply for adding a chemical agent to an atmosphere in the at least semi-enclosed space, the atmosphere with the chemical agent reducing a rate of evaporation of the substance from the ink;

a gripping head, the gripping head feeding sheets to the print cylinder;

a cooling mechanism for cooling the atmosphere within the at least semi-enclosed area;

a humidifier for controlling the humidity of the atmosphere within the at least semi-enclosed area; and a control unit coupled to the cooling mechanism, humidifier, and the chemical agent supply for selectively actuating the cooling mechanism to control the temperature, humidity, and amount of chemical agent in the atmosphere within the semi-enclosed area.

25. The printing unit according to claim 24, further comprising:

a temperature sensor mounted within the at least semi-enclosed space, and outputting a temperature signal to the control unit;

a humidity sensor mounted within the at least semi-enclosed space, and outputting a humidity signal to the control unit;

a chemical agent sensor mounted within the at least semi-enclosed space, and outputting a chemical agent level signal to the control unit; and wherein the control unit controls the cooling mechanism, the humidifier, and the chemical agent supply as a function of one or more of the temperature signal, the humidity signal, and the chemical agent signal.

26. The printing unit according to claim 24, wherein the housing includes a hollow interior, and wherein the cooling mechanism includes a cooling inlet connected to the hollow interior of the housing, and a cooling outlet connected to the hollow interior of the housing, the cooling mechanism including means for circulating a cooling agent into the cooling inlet, through the hollow interior of the housing, and out of the cooling outlet.

27. The printing unit according to claim 25, further including an air exhaust extending from the semi-enclosed space through to the exterior of the housing, the air exhaust being connected to the control unit, the control unit activating the air exhaust as a function of one or more of the temperature signal, the humidity signal, and the chemical agent signal.

28. The printing unit according to claim 24, wherein the chemical agent supply includes a reservoir for storing a solution containing the chemical agent, and a heater, the heater connected to the control unit.

29. A printing unit for a sheet-fed rotary printing press, comprising:

a print cylinder;

an inking mechanism for applying an ink to the print cylinder, the ink including an amine;

a housing at least partially surrounding the inking mechanism, an at least semi-enclosed space being formed between the housing and the inking mechanism;

a chemical agent supply for adding a chemical agent to an atmosphere in the at least semi-enclosed space, the atmosphere with the chemical agent reducing a rate of evaporation of the substance from the ink; and a gripping head, the gripping head feeding sheets to the print cylinder.

30. The printing unit according to claim 29 wherein the amine is an ethanol amine.

31. The printing unit according to claim 29, further comprising a blanket cylinder in rotational contact with the printing cylinder.

32. A printing unit for a sheet-fed rotary printing press, comprising:

a print cylinder;

an inking mechanism for applying an ink to the print cylinder, the ink including an amine;

a housing at least partially surrounding the print cylinder, an at least semi-enclosed space being formed between the housing and the print cylinder;

a chemical agent supply for adding a chemical agent to an atmosphere in the at least semi-enclosed space, the atmosphere with the chemical agent reducing a rate of evaporation of the substance from the ink; and a gripping head, the gripping head feeding sheets to the print cylinder.

33. The printing unit according to claim 32 wherein the amine is an ethanol amine.

34. The printing unit according to claim 32, further comprising a blanket cylinder in rotational contact with the printing cylinder.

35. A method for controlling an evaporation of a substance from an ink in a sheet-fed printing unit, the method comprising the steps of:

forming an at least semi-enclosed area around an inking unit and a print cylinder of a printing unit;

supplying a water based ink to the inking unit and the print cylinder, the ink including an amine; and supplying a chemical agent into an atmosphere within the semi-enclosed area so that the atmosphere within the semi-enclosed area reduces a rate of evaporation of the substance from the ink; and feeding sheets to the print cylinder.

36. The method according to claim 35, further comprising the steps of:

a) monitoring the atmosphere within the semi-enclosed space to obtain a temperature level;

b) monitoring the atmosphere within the semi-enclosed space to obtain a relative humidity level;

c) monitoring the atmosphere within the semi-enclosed space to obtain a chemical agent level;

d) controlling a temperature of the atmosphere within the semi-enclosed space as a function of one or more of the temperature level, the relative humidity level, and the chemical supply level;

e) controlling a relative humidity of the atmosphere within the semi-enclosed space as a function of one or more of the temperature level, the relative humidity level, and the chemical supply level;

and wherein the step of supplying further includes the step of f) supplying a chemical agent into the semi-enclosed area as a function of one or more of the temperature level, the relative humidity level, and the chemical supply level to reduce the rate of evaporation of the substance from the ink.

37. The printing unit according to claim 35 wherein the amine is an ethanol amine.

38. A printing unit for a sheet-fed rotary printing press for printing on a sheet having two sides, comprising a first print cylinder, the first print cylinder printing on a first side of the sheet;

an first inking mechanism for applying ink to the first print cylinder, the ink including a substance;

a second print cylinder located downstream of the first print cylinder, the second print cylinder printing on a second side of the sheet;

an second inking mechanism for applying ink to the second print cylinder, the ink including a substance;

at least one housing at least partially surrounding the first and second inking mechanisms, a first and a second at least semi-enclosed space being formed between the at least one housing and the first and second inking mechanisms, respectively;

at least one chemical agent supply adding a chemical agent to an atmosphere in the first and second at least semi-enclosed spaces, the atmosphere with the at least one chemical agent reducing a rate of evaporation of the substance from the ink.

39. The printing unit of claim 38, wherein:

the at least one housing comprises a first housing and a second housing, the first housing at least partially surrounding the first inking mechanism, the second housing at least partially surrounding the second inking mechanism.

40. The printing unit of claim 39, wherein:

the at least one chemical agent supply comprises a first chemical agent supply and a second chemical agent supply, the first chemical agent supply adding the chemical agent to an atmosphere in the first at least semi-enclosed space, the second chemical agent supply adding the chemical agent to an atmosphere in the second at least semi-enclosed space.

41. The printing unit according to claim 39 wherein the amine is an ethanol amine.

42. A printing unit for a sheet-fed rotary printing press, comprising:

a print cylinder;

an inking mechanism for applying an ink to the print cylinder, the ink including an amine;

a housing at least partially surrounding at least one of the inking mechanism and the print cylinder, an at least semi-enclosed space being formed between the housing and at least one of the inking mechanism and the print cylinder;

a cooling mechanism for cooling the atmosphere within the at least semi-enclosed area; and a gripping head, the gripping head feeding sheets to the print cylinder.

43. The printing unit of claim 42, further comprising:

insulating material surrounding the housing.

44. The printing unit of claim 42, wherein:

the cooling mechanism comprises a cooling outlet valve.

45. The printing unit of claim 42, further comprising:

a temperature sensor mounted within the at least semi-enclosed space.

46. The printing unit of claim 42, wherein:

the housing at least partially surrounds both the inking mechanism and the print cylinder.

47. The printing unit of claim 42, wherein:

the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

48. The printing unit according to claim 42 wherein the amine is an ethanol amine.

49. A printing unit for a sheet-fed rotary printing press including:

a print cylinder for supporting a print form suitable for printing with water based inks, the print form having an outer ink carry surface;

an inking unit for applying water based ink to the print form, the inking unit having an outer ink carrying surface, the ink including an amine;

a blanket cylinder for supporting a printing blanket, the printing blanket having an outer ink carrying surface; and a cooling unit for maintaining a temperature of the ink carrying surface of one or more of the print form, the inking unit, and the printing blanket at a predetermined level which is above a dew point of an atmosphere surrounding the outer ink carrying surfaces; and a gripping head, the gripping head feeding sheets to the print cylinder.

50. The printing unit according to claim 49, further comprising:

a temperature sensor mounted within the printing unit;

a control unit having an input coupled to the temperature sensor and an output connected to the cooling unit, the control unit controlling the cooling unit as a function of a temperature value received from the temperature sensor.

51. The printing unit according to claim 49, further comprising:

an air blower mounted within the printing unit, the air blower having an air intake for blowing air into an atmosphere around the blanket cylinder and an air exhaust for sucking air out of the atmosphere around the blanket cylinder.

52. The printing unit according to claim 51, wherein the air blower further comprises an air cooling mechanism.

53. The printing unit according to claim 51, wherein the air blower further comprises a humidifier.

54. The printing unit according to claim 51, wherein the air blower further comprises a fan and an air heating mechanism.

55. The printing unit according to claim 49 wherein the amine is an ethanol amine.

56. The printing unit according to claim 49, further comprising a blanket cylinder in rotational contact with the printing cylinder.

57. A printing unit for a sheet-fed rotary printing press, comprising:

a first print cylinder for supporting a print form suitable for printing with water based inks, the print form having an outer ink carry surface, the first print cylinder printing on a first side of a sheet;

a first inking unit for applying water based ink to the first print form, the first inking unit having an outer ink carrying surface; the first inking unit applying ink to the first print cylinder;

a second print cylinder located downstream of the first print cylinder, the second print cylinder printing on a second side of the sheet;

a second inking mechanism for applying ink to the second print cylinder, the ink including a substance;

a blanket cylinder for supporting a printing blanket, the printing blanket having an outer ink carrying surface;

a cooling unit for maintaining a temperature of the ink carrying surface of one or more of the print form, the inking unit, and the printing blanket at a predetermined level which is above a dew point of an atmosphere surrounding the outer ink carrying surfaces; and a gripping head, the gripping head feeding sheets to the print cylinder.

58. A printing unit for a sheet-fed rotary printing press, comprising:

a print cylinder for supporting a print form suitable for printing with water based inks, the print form having an outer ink carry surface;

an inking unit for applying water based ink to the print form, the inking unit having an outer ink carrying surface;

a blanket cylinder for supporting a printing blanket, the printing blanket having an outer ink carrying surface; and a cooling unit for maintaining a temperature of the ink carrying surface of one or more of the print form, the inking unit, and the printing blanket at a predetermined level which is above a dew point of an atmosphere surrounding the outer ink carrying surfaces; and a gripping head, the gripping head feeding sheets to the print cylinder;

wherein the cooling unit further comprises a blanket cylinder cooling unit coupled to the blanket cylinder, the blanket cylinder cooling unit circulating a second cooling agent through the blanket cylinder to maintain the outer ink carrying surface of the printing blanket at the predetermined level.

59. The printing unit according to claim 58, further comprising:

a blanket temperature sensor mounted within the printing unit;

a control unit having an input coupled to the blanket temperature sensor and an output connected to the blanket cylinder cooling unit, the control unit controlling a temperature of the second cooling agent as a function of a blanket temperature value received from the blanket temperature sensor.

60. A printing unit for a sheet-fed rotary printing press comprising:

a print cylinder for supporting a print form suitable for printing with water based inks, the print form having an outer ink carry surface;

an inking unit for applying water based ink to the print form, the inking unit having an outer ink carrying surface;

a blanket cylinder for supporting a printing blanket, the printing blanket having an outer ink carrying surface, an a cooling unit for maintaining a temperature of the ink carrying surface of one or more of the print form, the inking unit, and the printing blanket at a predetermined level which is above a dew point of an atmosphere surrounding the outer ink carrying surfaces;

a gripping head, the gripping head feeding sheets to the print cylinder;

an air blower mounted within the printing unit, the air blower having an air intake for blowing air into an atmosphere around the blanket cylinder and an air exhaust for sucking air out of the atmosphere around the blanket cylinder;

a blanket temperature sensor for monitoring a blanket temperature level of the printing blanket; and a control unit having an input connected to the blanket temperature sensor and having outputs connected to the air blower and the cooling unit, the control unit controlling the air blower and cooling unit as a function of the blanket temperature level received from the blanket temperature sensor.

* * * * *